US008864567B2

(12) United States Patent
Underdahl et al.

(10) Patent No.: US 8,864,567 B2
(45) Date of Patent: Oct. 21, 2014

(54) CASINO DISPLAY METHODS AND DEVICES

(75) Inventors: Brian Underdahl, VC Highlands, NV (US); Binh Nguyen, Reno, NV (US); Yuliya Hungate, Reno, NV (US); Steven G. LeMay, Reno, NV (US)

(73) Assignee: IGT, Las Vegas, NV (US)

( * ) Notice: Subject to any disclaimer, the term of this patent is extended or adjusted under 35 U.S.C. 154(b) by 437 days.

(21) Appl. No.: 11/880,937

(22) Filed: Jul. 24, 2007

(65) Prior Publication Data

US 2008/0020827 A1 Jan. 24, 2008

Related U.S. Application Data

(63) Continuation of application No. 11/517,861, filed on Sep. 7, 2006, now Pat. No. 8,545,326.

(51) Int. Cl.
*G06F 17/00* (2006.01)

(52) U.S. Cl.
USPC ..... 463/20; 463/12; 463/13; 273/274; 273/309

(58) Field of Classification Search
None
See application file for complete search history.

(56) References Cited

U.S. PATENT DOCUMENTS

| | | | | |
|---|---|---|---|---|
| 1,488,889 | A * | 4/1924 | Lollis | 40/606.08 |
| 3,864,024 | A | 2/1975 | Olson | |
| 4,127,849 | A | 11/1978 | Okor | |
| 4,448,419 | A | 5/1984 | Telnaes | |
| 4,614,342 | A * | 9/1986 | Takashima | 463/11 |
| 4,711,452 | A | 12/1987 | Dickinson et al. | |
| 4,712,799 | A | 12/1987 | Fraley | |
| 4,838,552 | A | 6/1989 | Hagiwara | |
| 4,856,787 | A * | 8/1989 | Itkis | 273/237 |
| 4,932,147 | A | 6/1990 | David | |
| 5,026,152 | A | 6/1991 | Sharkey | |
| 5,135,224 | A | 8/1992 | Yamamoto et al. | |
| 5,162,696 | A | 11/1992 | Goodrich | |
| 5,239,227 | A | 8/1993 | Kikinis | |
| 5,342,047 | A | 8/1994 | Heidel et al. | |
| 5,413,357 | A | 5/1995 | Schulze et al. | |
| 5,524,888 | A | 6/1996 | Heidel | |
| 5,580,055 | A | 12/1996 | Hagiwara | |

(Continued)

FOREIGN PATENT DOCUMENTS

| | | |
|---|---|---|
| EP | 0 134 979 A2 | 3/1985 |
| EP | 0 246 021 A2 | 11/1987 |

(Continued)

OTHER PUBLICATIONS

International Preliminary Report on Patentability dated Jul. 27, 2006 issued in PCT/US2005/000387.

(Continued)

*Primary Examiner* — Paul A D'Agostino
(74) *Attorney, Agent, or Firm* — Foley & Lardner LLP

(57) ABSTRACT

Novel methods, devices and systems are described for forming displays and creating environments in a casino. Some implementations of the invention provide configurable gaming machine skins, which may be formed from electronic paper or the like. Casino environments may be created in accordance with a game theme and/or to indicate a group of players. The environment may include configurable surfaces of gaming machines and/or nearby surfaces, such as walls, floors and ceilings. Projected light and/or an audio system may be used to enhance the immersive and dynamic environment. Preferably, some or all of these features may be changed automatically when a game theme changes.

19 Claims, 15 Drawing Sheets

(56) References Cited

U.S. PATENT DOCUMENTS

| | | | | |
|---|---|---|---|---|
| 5,634,080 | A | 5/1997 | Kikinis et al. | |
| 5,680,160 | A | 10/1997 | LaPointe | |
| 5,688,551 | A | 11/1997 | Littman et al. | |
| 5,752,881 | A | 5/1998 | Inoue | |
| 5,770,533 | A * | 6/1998 | Franchi | 463/42 |
| 5,770,914 | A | 6/1998 | Pease et al. | |
| 5,788,573 | A | 8/1998 | Baerlocher et al. | |
| 5,803,453 | A | 9/1998 | Stephan et al. | |
| 5,807,172 | A | 9/1998 | Piechowiak | |
| 5,816,918 | A * | 10/1998 | Kelly et al. | 463/16 |
| 5,839,957 | A | 11/1998 | Schneider et al. | |
| 5,839,960 | A * | 11/1998 | Parra et al. | 463/41 |
| 5,911,419 | A * | 6/1999 | Delaney et al. | 273/292 |
| 5,924,926 | A * | 7/1999 | Brown | 463/11 |
| 5,929,474 | A | 7/1999 | Huang et al. | |
| 5,934,672 | A | 8/1999 | Sines et al. | |
| 5,947,820 | A | 9/1999 | Morro et al. | |
| 5,951,397 | A | 9/1999 | Dickinson | |
| 5,965,907 | A | 10/1999 | Huang et al. | |
| 5,971,271 | A | 10/1999 | Wynn et al. | |
| 5,977,704 | A | 11/1999 | Shi et al. | |
| 6,002,206 | A | 12/1999 | Harrison et al. | |
| 6,008,784 | A | 12/1999 | Acres et al. | |
| 6,016,176 | A | 1/2000 | Kim et al. | |
| 6,027,115 | A | 2/2000 | Griswold et al. | |
| 6,033,307 | A | 3/2000 | Vancura | |
| 6,068,552 | A | 5/2000 | Walker et al. | |
| 6,070,228 | A | 5/2000 | Belknap et al. | |
| 6,075,316 | A | 6/2000 | Shi et al. | |
| 6,082,887 | A | 7/2000 | Feuer et al. | |
| 6,086,066 | A | 7/2000 | Takeuchi et al. | |
| 6,135,884 | A | 10/2000 | Hedrick et al. | |
| 6,155,925 | A | 12/2000 | Giobbi et al. | |
| 6,162,121 | A | 12/2000 | Morro et al. | |
| 6,165,069 | A * | 12/2000 | Sines et al. | 463/12 |
| 6,166,496 | A * | 12/2000 | Lys et al. | 315/316 |
| 6,193,235 | B1 * | 2/2001 | Vancura et al. | 273/292 |
| 6,205,690 | B1 | 3/2001 | Heropoulos et al. | |
| 6,229,505 | B1 | 5/2001 | Fujii | |
| 6,251,014 | B1 | 6/2001 | Stockdale et al. | |
| 6,254,481 | B1 | 7/2001 | Jaffe et al. | |
| 6,264,561 | B1 | 7/2001 | Saffari et al. | |
| 6,287,202 | B1 | 9/2001 | Pascal et al. | |
| 6,315,666 | B1 | 11/2001 | Mastera et al. | |
| 6,366,016 | B1 | 4/2002 | Sakaguchi et al. | |
| 6,368,216 | B1 | 4/2002 | Hedrick et al. | |
| 6,406,371 | B1 | 6/2002 | Baba et al. | |
| 6,454,649 | B1 | 9/2002 | Mattice et al. | |
| 6,464,581 | B1 | 10/2002 | Yoseloff et al. | |
| 6,485,884 | B2 | 11/2002 | Wolk et al. | |
| 6,502,758 | B2 | 1/2003 | Cottrell | |
| 6,503,147 | B1 | 1/2003 | Stockdale et al. | |
| 6,517,433 | B2 | 2/2003 | Loose et al. | |
| 6,523,824 | B1 | 2/2003 | Colapinto et al. | |
| 6,530,165 | B2 | 3/2003 | Griesemer et al. | |
| 6,609,968 | B1 | 8/2003 | Okada et al. | |
| 6,638,165 | B2 | 10/2003 | Uchiyama et al. | |
| 6,659,866 | B2 * | 12/2003 | Frost et al. | 463/17 |
| 6,722,987 | B2 | 4/2004 | Orr et al. | |
| 6,743,094 | B2 * | 6/2004 | Johnson | 463/17 |
| 6,743,102 | B1 | 6/2004 | Fiechter et al. | |
| 6,773,345 | B2 | 8/2004 | Walker et al. | |
| 6,786,818 | B1 | 9/2004 | Rothschild et al. | |
| 6,798,148 | B2 | 9/2004 | Inukai | |
| 6,817,946 | B2 | 11/2004 | Motegi et al. | |
| 6,893,345 | B2 | 5/2005 | Motegi et al. | |
| 6,896,264 | B1 * | 5/2005 | Haber | 273/274 |
| 6,908,387 | B2 | 6/2005 | Hendrick et al. | |
| 6,911,781 | B2 | 6/2005 | Yamazaki et al. | |
| 6,923,720 | B2 | 8/2005 | Loose | |
| 6,939,226 | B1 | 9/2005 | Joshi | |
| 7,004,465 | B2 * | 2/2006 | Keith | 273/108 |
| 7,008,324 | B1 | 3/2006 | Johnson et al. | |
| 7,048,629 | B2 * | 5/2006 | Sines et al. | 463/16 |
| 7,053,890 | B2 | 5/2006 | Inukai | |
| 7,121,945 | B2 | 10/2006 | Suganuma et al. | |
| 7,169,048 | B2 | 1/2007 | Nozaki et al. | |
| 7,204,753 | B2 | 4/2007 | Ozaki et al. | |
| 7,335,101 | B1 | 2/2008 | Luciano | |
| 7,344,442 | B2 | 3/2008 | Inoue | |
| 7,542,198 | B2 | 6/2009 | Kothari | |
| 7,618,316 | B2 * | 11/2009 | Cole et al. | 463/21 |
| 7,682,249 | B2 | 3/2010 | Winans et al. | |
| 7,811,170 | B2 | 10/2010 | Winans et al. | |
| 7,887,408 | B2 | 2/2011 | Walker et al. | |
| 8,002,624 | B2 | 8/2011 | Paulsen et al. | |
| 8,016,670 | B2 | 9/2011 | LeMay et al. | |
| 8,092,305 | B2 | 1/2012 | Seelig et al. | |
| 8,096,878 | B2 | 1/2012 | Durham et al. | |
| 8,137,176 | B2 | 3/2012 | Bernard et al. | |
| 8,235,824 | B2 * | 8/2012 | Kuhn | 463/46 |
| 8,480,091 | B1 * | 7/2013 | Florence | 273/309 |
| 2002/0012898 | A1 | 1/2002 | Shechter et al. | |
| 2002/0082083 | A1 | 6/2002 | Ito et al. | |
| 2002/0142846 | A1 | 10/2002 | Paulsen | |
| 2002/0152364 | A1 | 10/2002 | Gunaseelan et al. | |
| 2002/0173354 | A1 | 11/2002 | Winans et al. | |
| 2002/0175466 | A1 | 11/2002 | Loose et al. | |
| 2002/0187831 | A1 | 12/2002 | Arikawa et al. | |
| 2003/0032479 | A1 | 2/2003 | LeMay et al. | |
| 2003/0045343 | A1 | 3/2003 | Luccesi et al. | |
| 2003/0060269 | A1 | 3/2003 | Paulsen et al. | |
| 2003/0064784 | A1 | 4/2003 | Wells et al. | |
| 2003/0071418 | A1 * | 4/2003 | Saucier | 273/292 |
| 2003/0074486 | A1 | 4/2003 | Anastasiadis et al. | |
| 2003/0094752 | A1 * | 5/2003 | Mathews | 273/138.1 |
| 2003/0195045 | A1 | 10/2003 | Kaminkow et al. | |
| 2003/0218300 | A1 * | 11/2003 | Timmons, Sr. | 273/146 |
| 2003/0220134 | A1 | 11/2003 | Walker et al. | |
| 2003/0220139 | A1 | 11/2003 | Peterson | |
| 2003/0232651 | A1 * | 12/2003 | Huard et al. | 463/42 |
| 2004/0070149 | A1 * | 4/2004 | Lipscomb et al. | 273/309 |
| 2004/0082373 | A1 * | 4/2004 | Cole et al. | 463/13 |
| 2004/0082385 | A1 | 4/2004 | Silva et al. | |
| 2004/0102245 | A1 | 5/2004 | Escalera et al. | |
| 2004/0142745 | A1 | 7/2004 | Hosaka | |
| 2004/0166940 | A1 | 8/2004 | Rothschild | |
| 2004/0219978 | A1 | 11/2004 | Teramoto et al. | |
| 2004/0266518 | A1 | 12/2004 | Gauselmann et al. | |
| 2005/0049049 | A1 * | 3/2005 | Griswold et al. | 463/46 |
| 2005/0054423 | A1 | 3/2005 | Wadleigh | |
| 2005/0054440 | A1 | 3/2005 | Anderson et al. | |
| 2005/0101387 | A1 | 5/2005 | Wolf | |
| 2005/0153776 | A1 | 7/2005 | LeMay et al. | |
| 2005/0170736 | A1 | 8/2005 | Cok | |
| 2005/0170890 | A1 | 8/2005 | Rowe et al. | |
| 2005/0272505 | A1 | 12/2005 | Okamura | |
| 2006/0014580 | A1 | 1/2006 | Hawthorn | |
| 2006/0100013 | A1 | 5/2006 | Enzminger | |
| 2006/0100019 | A1 | 5/2006 | Hornick | |
| 2006/0128467 | A1 | 6/2006 | Thomas | |
| 2006/0281529 | A1 | 12/2006 | Seelig et al. | |
| 2007/0004510 | A1 | 1/2007 | Underdahl et al. | |
| 2007/0052660 | A1 | 3/2007 | Montbach et al. | |
| 2007/0054730 | A1 | 3/2007 | Mattice et al. | |
| 2007/0093290 | A1 | 4/2007 | Winans et al. | |
| 2007/0283265 | A1 | 12/2007 | Portano | |
| 2007/0293299 | A1 | 12/2007 | Aida | |
| 2008/0096624 | A1 | 4/2008 | Rydberg | |
| 2008/0200233 | A1 | 8/2008 | Aida | |
| 2008/0214277 | A1 | 9/2008 | Kishi | |
| 2009/0104969 | A1 | 4/2009 | Paulsen et al. | |

FOREIGN PATENT DOCUMENTS

| | | | |
|---|---|---|---|
| EP | 0 288 152 | B1 | 10/1988 |
| EP | 0896308 | A1 | 2/1999 |
| EP | 1 082 980 | A2 | 3/2001 |
| EP | 1 291 829 | | 3/2003 |
| EP | 1 422 673 | | 5/2004 |
| EP | 1 550 987 | | 7/2005 |
| GB | 2092795 | | 8/1982 |
| GB | 2116345 | | 9/1983 |
| GB | 2253299 | | 9/1992 |

(56) References Cited

FOREIGN PATENT DOCUMENTS

| | | |
|---|---|---|
| GB | 2447481 | 9/2008 |
| JP | 2000 172444 | 6/2000 |
| JP | 2001 076886 | 3/2001 |
| JP | 2002-360908 | 12/2002 |
| JP | 2004-081826 | 3/2004 |
| JP | 2004-089689 | 3/2004 |
| WO | WO 98/03962 | 1/1998 |
| WO | WO 98/50804 | 11/1998 |
| WO | WO 00/55879 | 9/2000 |
| WO | WO 00/60669 | 10/2000 |
| WO | WO 02/17613 | 2/2002 |
| WO | WO 02/091319 | 11/2002 |
| WO | WO 2005/071628 | 8/2005 |
| WO | WO 2005/114600 | 12/2005 |
| WO | WO 2008/030781 | 3/2008 |
| WO | WO 2008/057929 | 5/2008 |
| WO | WO 2010/042328 | 4/2010 |

OTHER PUBLICATIONS

International Search Report dated Apr. 16, 2008 issued in PCT/US2007/083315.
Written Opinion dated Apr. 16, 2008 issued in PCT/US2007/083315.
International Search Report dated Apr. 9, 2008 issued in PCT/US2007/077453.
Written Opinion dated Apr. 9, 2008 issued in PCT/US2007/077453.
Chinese Office Action dated Nov. 28, 2008 issued in 200580002282.8.
Russian Office Action dated Dec. 15, 2006 issued in 2006124191/09 (026231).
Russian Office Action dated Dec. 8, 2008 issued in 2006124191/09 (026231).
U.S. Office Action dated Jul. 12, 2007 issued in U.S. Appl. No. 10/756,225.
U.S. Final Office Action dated Jan. 8, 2008 issued in U.S. Appl. No. 10/756,225.
U.S. Office Action dated Jun. 26, 2008 issued in U.S. Appl. No. 10/756,225.
U.S. Final Office Action dated Feb. 2, 2009 issued in U.S. Appl. No. 10/756,225.
US Notice of Allowance dated Sep. 22, 1999 issued in U.S. Appl. No. 09/047,889.
US Office Action dated Mar. 30, 1999 issued in U.S. Appl. No. 09/047,889.
US Office Action dated Mar. 24, 2003 issued in U.S. Appl. No. 09/964,962.
US Office Action dated Oct. 7, 2003 issued in U.S. Appl. No. 09/964,962.
US Final Office Action dated Apr. 26, 2004 issued in U.S. Appl. No. 09/964,962.
US Office Action dated May 2, 2006 issued in U.S. Appl. No. 09/964,962.
US Office Action (Interview Summary) dated Jul. 10, 2006 issued in U.S. Appl. No. 09/964,962.
US Final Office Action dated Dec. 7, 2006 issued in U.S. Appl. No. 09/964,962.
US Office Action dated Sep. 20, 2007 issued in U.S. Appl. No. 09/964,962.
US Final Office Action dated Aug. 8, 2008 issued in U.S. Appl. No. 09/964,962.
U.S. Appl. No. 12/247,844, filed Oct. 8, 2008.
AV Video Multimedia Producer (Jun. 2001) "Announce World's First Video-Capable Flexible Plastic LCD Display" [online] [retrieved on Mar. 17, 2003] Retrieved from: http://www.avvideo.com/2001/06_jun/news/plastic_video.htm, 3 pp.
Planar Operations Manual (prior to Jan. 1997) "Electroluminescent Display" Planar America, Inc., 1400 NW Campton Drive, Beaverton, Oregon 97006, 3 pp.
Display of "High Rollers Triple Diamond" Gaming Machine at a casino in Nevada in about 1995 (photograph of similar machine) 2 pp.
Schröder, Tim (Feb. 28, 2005) "Microelectronics Display Panels with Electronic Ink", *Fraunhofer Magazin*,Fraunhofer Gesellschaft, Muenchen, DE, 2:38-39, XP-002344237.
"First Generation Electronic Paper Display From Philips, Sony and E Ink to be Used in New Electronic Reading Device", (Mar. 24, 2004) [online] [retrieved on Sep. 8, 2005] Retrieved from: URL:http://www.eink.com/news/releases/pr70.html, 2 pp. XP-002344236.
"FOLED Flexible Organic Light Emitting Device," Universal Display Corporation [online] [retrieved on Apr. 26, 2001] Retrieved from: http://www.universaldisplay.com/foled.php, 2 pp.
Kavoossi B, (Dec. 12, 2001) "Printed Micro Systems on Paper", [online] [retrieved on Sep. 9, 2005] Retrieved from: URL:http://www.tekes.fi/julkaisut/Active_imaging.pdf, pp. 1-106, XP-002344235.
Lieberman, David, (Jun. 15, 1999) "Push is on to Replace Glass with Plastic in LCDs," [online] [retrieved Sep. 6, 2000] Retrieved from: http://www.eetimes.com/story/OEG19990615S0031, EETIMES.com, *The Technology Site for Engineers and Technical Management*, pp. 1-4.
"The Tube"(Mar. 6, 2000) Businessweek Online [online] [retrieved on Dec. 20, 2001] Retrieved from: http://www/businessweek.com:/2000/00_10/design3.htm?scriptFramed, pp. 1-2.
International Search Report, mailed Jun. 6, 2005 from related PCT Application US2005/000387, 3 pp.
Written Opinion of the International Searching Authority, mailed Jun. 6, 2005 from related PCT Application US2005/000387, 5 pp.
Del Conte, Natali T., "Philips Demos Digital Game Board" downloaded from internet at http://www.pcmag.com/article2/0,1895,2009874.asp, Article date: Aug. 29, 2006, 2 pages.
European Office Action dated Apr. 24, 2009 issued in 05705161.7.
Mexican Office Action dated May 12, 2009 issued in 06/07949.
U.S. Final Office Action dated Apr. 21, 2009 issued in U.S. Appl. No. 09/964,962.
U.S. Office Action dated Jul. 6, 2009 issued in U.S. Appl. No. 09/964,962.
US Office Action dated Jul. 7, 2009 issued in U.S. Appl. No. 10/756,225.
U.S. Office Action dated Jun. 23, 2009 issued in U.S. Appl. No. 11/517,861.
US Advisory Action dated Apr. 21, 2009 issued in U.S. Appl. No. 10/756,225.
US Office Action dated Apr. 28, 2011 issued in U.S. Appl. No. 10/756,225.
US Examiner Interview Summary dated May 10, 2011 issued in U.S. Appl. No. 10/756,225.
US Notice of Allowance dated Jun. 24, 2011 issued in U.S. Appl. No. 10/756,225.
US Notice of Allowance dated Jul. 18, 2011 issued in U.S. Appl. No. 10/756,225.
US Office Action dated Jun. 25, 2010 issued in U.S. Appl. No. 11/592,614.
US Office Action Final dated Nov. 1, 2010 issued in U.S. Appl. No. 11/592,614.
US Examiner Interview Summary dated Sep. 18, 2009 issued in U.S. Appl. No. 11/517,861.
US Office Action dated Mar. 15, 2010 issued in U.S. Appl. No. 11/517,861.
US Office Action dated Jul. 28, 2011 issued in U.S. Appl. No. 11/517,861.
US Examiner Interview Summary dated Office Action dated Sep. 26, 2011 issued in U.S. Appl. No. 11/517,861.
US Office Action Final dated Mar. 16, 2010 issued in U.S. Appl. No. 09/964,962.
US Office Action Final dated Aug. 16, 2010 issued in U.S. Appl. No. 09/964,962.
US Office Action dated Dec. 21, 2010 issued in U.S. Appl. No. 09/964,962.
US Examiner Interview Summary dated Mar. 10, 2011 issued in U.S. Appl. No. 09/964,962.
US Notice of Allowance dated Apr. 1, 2011 issued in U.S. Appl. No. 09/964,962.
US Office Action dated Oct. 5, 2005 issued in U.S. Appl. No. 10/139,801.

(56) References Cited

OTHER PUBLICATIONS

US Office Action Final dated Mar. 16, 2006 issued in U.S. Appl. No. 10/139,801.
US Office Action dated Jul. 6, 2006 issued in U.S. Appl. No. 10/139,801.
US Office Action Final dated Jan. 5, 2007 issued in U.S. Appl. No. 10/139,801.
US Advisory Action dated Apr. 4, 2007 issued in U.S. Appl. No. 10/139,801.
US Examiner Interview Summary dated Apr. 26, 2007 issued in U.S. Appl. No. 10/139,801.
US Office Action dated Jun. 4, 2007 issued in U.S. Appl. No. 10/139,801.
US Office Action Final dated Feb. 21, 2008 issued in U.S. Appl. No. 10/139,801.
US Office Action dated Aug. 20, 2008 issued in U.S. Appl. No. 10/139,801.
US Office Action dated Jan. 30, 2009 issued in U.S. Appl. No. 10/139,801.
US Examiner Interview Summary dated Aug. 13, 2009 issued in U.S. Appl. No. 10/139,801.
US Notice of Allowance dated Sep. 14, 2009 issued in U.S. Appl. No. 10/139,801.
US Notice of Allowance dated Dec. 2, 2009 issued in U.S. Appl. No. 10/139,801.
US Office Action dated Oct. 31, 2008 issued in U.S. Appl. No. 11/546,659.
US Office Action dated May 12, 2009 issued in U.S. Appl. No. 11/546,659.
US Examiner Interview Summary dated Aug. 12, 2009 issued in U.S. Appl. No. 11/546,659.
US Notice of Allowance dated Apr. 20, 2010 issued in U.S. Appl. No. 11/546,659.
US Notice of Allowance dated Aug. 26, 2010 issued in U.S. Appl. No. 11/546,659.
AU Examiner's First Report dated Nov. 13, 2009 issued in 2005207295.
AU Notice of Acceptance dated Aug. 25, 2010 issued in 2005207295.
Canadian Office Action dated Apr. 12, 2011 issued in CA 2,552,400.
Chinese Second Office Action dated Mar. 1, 2010 issued in 200580002282.8.
Chinese Third Office Action dated Feb. 16, 2011 issued in 200580002282.8.
Chinese Fourth Office Action dated Sep. 15, 2011 issued in 200580002282.8.
AU Examiner's first report dated Aug. 5, 2011 issued in AU 2007317424.
European Examination Report dated Oct. 30, 2009 issued in 07 863 774.1-2221.
European Examination Report dated Jun. 4, 2010 issued in 07 863 774.1-2221.
PCT International Search Report and Written Opinion dated Jan. 21, 2010 issued in PCT/US2009/058261.
PCT International Preliminary Report on Patentability and Written Opinion dated Apr. 21, 2010 issued in PCT/US2009/058261.
PCT International Search Report dated Aug. 14, 2003 issued in PCT/US02/13863.
PCT Written Opinion dated Sep. 24, 2003 issued in PCT/US02/13863.
PCT International Preliminary Examination Report dated Nov. 24, 2003 issued in PCT/US02/13863.
Patent Abstracts of Japan vol. 2000, No. 09, Oct. 13, 2000 & JP 2000 172444 A (Semiconductor Energy Lab Co LTD), Jun. 23, 2000 abstract.
Patent Abstracts of Japan vol. 2000, No. 20, Jul. 10, 2001 & JP 2001 076886 A (Futaba Corp), Mar. 23, 2001 abstract.
Australian Examiner's First Report dated Feb. 16, 2007 issued in AU 2002256429.
Australian Examiner's First Report dated Jan. 15, 2009 issued in AU 2007216701.
EP Examination Report dated Dec. 9, 2005 issued in EP 02 725 894.6-2218.
EP Examination Report dated Jan. 12, 2007 issued in EP 02 725 894.6-2218.
EP Examiner's Report dated Jul. 20, 2009 issued in EP 02 725 894.6-2218.
IBM, *Organic Light Emitting Diodes Project*, downloaded from Internet Apr. 16, 2002, http://www.almaden.ibm.com/st/projects/oleds/ 4 pages.
Kodak, *What It Is* downloaded from Internet Apr. 25, 2002, http://www.kodak.corn/US/en/corp/display/overview.jhtml 9 pages.
Rolltronics, by Dr. James Sheats, *Introduction to Organic Light-Emitting Diodes* (*OLEDs*), downloaded from Internet Apr. 16, 2002, http://www.rolltronics.com/intro_oled.htp 9 pages.
Universal Display Corporation, "From Passive to Active Matrix", downloaded from Internet Apr. 25, 2002, http://www.universaldisplay.com/matrix.php 2 pages.
Universal Display Corporation, *FOLED Flexible Organic Light Emitting Device*, downloaded from Internet Apr. 25, 2002, http://www.universaldisplay.com/folded.php 2 pages.
US Applicant Initiated Interview Summary dated May 16, 2012 issued in U.S. Appl. No. 12/247,844.
US Notice of Allowance dated Jul. 16, 2012 issued in U.S. Appl. No. 12/247,844.
US Allowed Claims dated Jul. 16, 2012 for U.S. Appl. No. 12/247,844.
Canadian Second Office Action dated Mar. 28, 2012 issued in CA 2,552,400.
Notice of Allowance for U.S. Appl. No. 11/517,861, mail date Jun. 3, 2013, 6 pages.
Office Action regarding Canadian Application No. 2,552,400, mail date Mar. 28, 2013, 4 pages.
US Final Office Action dated Nov. 2, 2011 issued in U.S. Appl. No. 11/517,861.
US Office Action dated Mar. 27, 2012 issued in U.S. Appl. No. 12/247,844.
Chinese Fifth Office Action dated Dec. 23, 2011 issued in 200580002282.8.
PCT International Preliminary Report on Patentability and Written Opinion dated Mar. 10, 2009 issued in PCT/US2007/083315.
AU Examiner's report No. 2 dated Dec. 20, 2011 issued in AU 2007317424.
European Communication Report dated Feb. 3, 2011 issued in 07 863 774.1-2221.
PCT International Preliminary Report on Patentability and Written Opinion dated Mar. 10, 2009 issued in PCT/US2007/077453.

* cited by examiner

CASINO DISPLAY METHODS AND DEVICES

CROSS-REFERENCE TO RELATED APPLICATION

This application is a continuation of U.S. patent application Ser. No. 11/517,861, filed on Sep. 7, 2006, now U.S. Pat. No. 8,545,326 which is related to U.S. patent application Ser. No. 10/756,225, entitled "VIRTUAL GLASS FOR A GAMING MACHINE" and filed on Jan. 12, 2004, both of which are hereby incorporated by reference for all purposes.

FIELD OF THE INVENTION

The present disclosure relates to displays for gaming machines and gaming establishments.

BACKGROUND OF THE INVENTION

Casinos and other forms of gaming establishments comprise a growing, multibillion dollar industry wherein floor space is at a premium. Newer, more popular and increasingly sophisticated games and machines are preferred over older and less popular ones. For example, the casino and gaming industries have experienced a marked shift over the past few decades not only from the prevalence of table games to gaming machines, but also from the use of fully mechanical gaming machines to electronic and microprocessor based gaming machines.

In a typical gaming machine, such as a video poker or slot machine, a game play is first initiated through a player wager of money or credit, whereupon the gaming machine determines a game outcome, presents the game outcome to the player and then potentially dispenses an award of some type, including a monetary award, depending on the game outcome. Although this process is generally true for both mechanical and electronic gaming machines, the electronic machines tend to be more popular with players and thus more lucrative for casinos for a number of reasons, such as increased game varieties, more attractive and dynamic presentations and the ability to award larger jackpots.

Electronic and microprocessor-based gaming machines can include a number of hardware and software components to provide a wide variety of game types and game playing capabilities. A typical electronic gaming machine comprises a central processing unit ("CPU") or master gaming controller ("MGC") that controls various combinations of hardware and software devices and components that encourage game play, allow a player to play a game on the gaming machine and control payouts and other awards. Software components can include, for example, boot and initialization routines, various game play programs and subroutines, credit and payout routines, image and audio generation programs, various component modules and a random number generator, among others. Exemplary hardware devices can include bill validators, coin acceptors, card readers, keypads, buttons, levers, touch screens, coin hoppers, ticket printers, player tracking units and the like.

In addition, each gaming machine can have various audio and visual display components that can include, for example, speakers, display panels, belly and top glasses, exterior cabinet artwork, lights, and top box dioramas, as well as any number of video displays of various types to show game play and other assorted information, with such video display types including, for example, a cathode ray tube ("CRT"), a liquid crystal display ("LCD"), a light emitting diode ("LED"), a flat panel display and/or a plasma display, among others.

Devices and methods for providing displays in gaming machines and/or within a casino are described, for example, in U.S. Pat. No. 5,971,271, 6,135,884, 6,251,014 and 6,503,147, all of which are incorporated herein by reference in their entirety and for all purposes.

The use of quality visual and audio display components to encourage, heighten and maintain interest in game play is often an important consideration for a casino operator or gaming establishment proprietor. Variety and interchangeability in games and machine displays are also important characteristics, as interest in any given game or display tends to decrease over time. Electronic gaming machines have traditionally been relatively simple, however, in that the various displays, functions and peripheral devices associated with any particular gaming machine are usually limited for any given machine.

In general, the functionality of a traditional gaming machine has been relatively constant in that new displays, themes, peripheral devices and gaming software are infrequently added to any particular machine once that machine has been deployed. In addition, the connections, communication protocols, and software drivers for many peripheral devices are often customized and proprietary, varying from manufacturer to manufacturer and from peripheral device to peripheral device, such that the swapping out of different model peripherals is usually impractical.

Although it may become desirable to change a game theme or add new capabilities or features to a particular gaming machine once that machine has been deployed, such changes can be expensive and particularly difficult if new or updated gaming software and/or peripheral devices are involved. In even a simple example, the creation and installation of artwork and information on various gaming machine displays, such as a top glass and belly glass, is a very resource-intensive task. Typically, artwork is silk-screened onto a top glass and/or belly glass by a controlled and expensive process. (Although the term "glass" is used, the material may be one of various types, including but not limited to glass or plastic.)

Because these displays are usually backlit such that light shines through the glass, the quality of the silk-screen process must be high to ensure that pinholes or other defects in the painted areas are not present. Even a simple retrofit of a gaming machine to provide a different theme can involve the replacement of a top glass, a belly glass, and reel strips (on a spinning reel slot machine), among other items. Although often desirable, such retrofitting results in at least the costs of purchasing and installing new silk-screened glasses, even where new software and/or other electronic components are not needed. Hence, retrofitting a machine to generate and maintain interest in game play can represent a significant expense to a casino.

Another method of gaining and maintaining interest in game play is to provide a gaming machine with a plurality of games. Although gaming machines have traditionally provided only a single game per machine, recent innovations have resulted in machines that permit a player to select from a number of different games on the same machine. On some networked gaming machines, the game theme may changed according to instructions from a game server, e.g., as described in U.S. patent application Ser. No. 11/225,407 , filed on Sep. 12, 2005 and entitled "METHODS AND DEVICES FOR MANAGING GAMING NETWORKS" (the "SBG Application"), which is hereby incorporated by reference for all purposes.

However, such multi-game machines typically have the same exterior artwork, top glass and belly glass for whichever game is selected, such that these display items tend to be fairly generic in nature on such machines. It is not practical to have a single multi-game machine with standard silk-screened glasses and other permanent displays that reflect, for example, both an "Elvis" themed game and a "Star Wars" themed game available on the same machine.

Although the issue of variable visual displays has been partially addressed through recent introductions of secondary and even tertiary video screens, such video screens tend to be relatively expensive and event-driven media-slave devices, the use of which results in a need for substantial associated memory or storage units and the additional power and space required to accommodate such displays and units. Furthermore, these added video screens are limited in that they are restricted to a single video image source (sometimes referred to herein as a "host") within the gaming machine itself, such as the MGC or an associated video control slave chip, and can only display that which has already been programmed into the host or any of its associated memory units. As a result, any newly desired game or display changes in a deployed machine still results in the need for undesirable retrofitting and/or software upgrades and updates.

In view of the above observations, it would be desirable to provide a visual display for a gaming machine that reduces the expense and inconvenience of updating thematic displays on the gaming machine. It would also be desirable to provide displays with increased flexibility.

SUMMARY OF THE INVENTION

Novel methods, devices and systems are described for forming displays and creating environments in a casino. Some implementations of the invention provide configurable gaming machine skins, which may be formed from electronic paper or the like. Casino environments may be created in accordance with a game theme and/or to indicate one or more groups of players. The environment may include configurable surfaces of gaming machines and/or nearby surfaces, such as walls, floors and ceilings. Preferably, some or all of these features may be changed automatically when a game theme changes.

Some implementations of the invention provide an interactive, immersive gaming environment that may include group bonus events, changeable environments, etc. Groups and/or sub-groups (such as teams of players) may be indicated by distinctive differences between gaming machines and/or other aspects of the environment. For example, the walls, ceiling, signage and/or floor of an area may correspond with a particular game theme for which the gaming machines in the area are configured to provide. Within this area, there may be teams indicated, e.g., by different colors. Some such implementations include a projection display system and/or an audio system that has been configured and programmed according to methods described herein. For example, displays may be projected onto the ceiling, walls, or floor of a gaming area. Some such displays may be controlled by interactive gesture-based systems.

Some implementations of the invention provide an electronically configurable table for playing table games. An operator may select a desired game, such as a poker game or a blackjack game, and the table will be automatically configured with geometrical patterns, text, etc., which are appropriate for the desired table game. The desired type of table game may be selected by a control on the table itself or according to instructions received from, e.g., a server or a casino manager via a network interface. In some preferred embodiments, electronic paper provides an electronically configurable surface for the table. Alternatively, or additionally, displays may be projected onto the underside of a translucent gaming surface. The table games may be conducted by a dealer or by using some form of automation, which may include, e.g., cameras and/or radio frequency identification devices, etc.

Some implementations of the invention involve a gaming machine that includes various devices for providing wagering games and game displays, including one or more logic devices. At least some of the game displays may be provided by one or more configurable surfaces. The game displays may be associated with game themes and may comprise static and/or dynamic displays. The configurable surfaces may, in some implementations, continue to display an image even when power is removed.

The gaming machine may also include one or more devices for receiving an indication to change a game theme and a game display. For example, the gaming machine may include a user interface for receiving an indication to change a game theme from a player, a technician, etc.

Alternatively, or additionally, the gaming machine may include an interface (e.g., a network interface) for receiving an indication to change a game theme from another device. The other device could be, for example, an environment controller, another gaming machine, a server, a host device, etc. Gaming machines that include a network interface may be configured to receive software, e.g., for providing wagering games, via the network interface. Moreover, such gaming machines may be configured to receive instructions for providing wagering games and/or instructions for presenting game displays via the network interface.

The gaming machine may also be configured to cooperate with at least one other device to present game theme displays on one or more surfaces outside of the gaming machine. The surface(s) outside of the gaming machine may comprise one or more surfaces of another gaming machine and/or one or more surfaces of an environment near the gaming machine. The one or more surfaces outside of the gaming machine may comprise one or more configurable surfaces and/or surfaces on which displays are projected. For example, the one or more surfaces outside of the gaming machine may comprise a wall surface, a floor surface, a ceiling surface and/or a sign surface.

The gaming machine is preferably configured to control one or more configurable surfaces of the gaming machine to present a first game theme display, e.g., when configured for providing (or at least offering) a wagering game according to the first game theme. In some embodiments, at least one configurable surface of the gaming machine comprises electronic paper. After receiving an indication to change the game display, the gaming machine may stop presenting a first game theme display and to start presenting a second game theme display. The gaming machine may be configured for providing (or at least offering) a wagering game according to the second game theme.

The gaming machine may be configured to cooperate with at least one other gaming machine to provide wagering games as group wagering games. In some such embodiments, a user interface of the gaming machine is configured to receive a request to provide the group wagering games.

The invention also provides various gaming methods. One such method includes the following steps: receiving a first indication for a first plurality of gaming machines to stop executing a first game theme and stop displaying a first game theme skin; controlling the first plurality of gaming machines to stop executing the first game theme and stop displaying the first game theme skin; receiving a second indication for the first plurality of gaming machines to start executing a second game theme and start displaying a second game theme skin; and controlling the first plurality of gaming machines start executing the second game theme and start displaying the second game theme skin. The controlling steps may involve controlling surfaces of the first plurality of gaming machines to alter their appearances.

The controlling steps may comprise rearranging patterns of electrical charges on configurable surfaces, e.g., of the first plurality of gaming machines. Some such methods involve controlling electronic paper disposed on surfaces of the first plurality of gaming machines. The receiving steps may involve receiving instructions from a gaming establishment operator and/or from a server.

The method may also involve these steps: receiving a third indication to change a first environment of the first plurality of gaming machines from a first game theme environment to a second game theme environment; and changing the first environment from a first game theme environment to a second game theme environment. The step of changing the display may involve, e.g., changing a projected light display and/or changing a configurable surface display (such as an electronic paper display). The method may also involve changing an audio environment from first game theme sounds to second game theme sounds.

The method may also include these steps: receiving a third indication for a second plurality of gaming machines to stop executing a third game theme and stop displaying a third game theme skin; controlling the second plurality of gaming machines to stop executing the third game theme and stop displaying the third game theme skin; receiving a fourth indication for the second plurality of gaming machines to start executing a fourth game theme and start displaying a fourth game theme skin; and controlling the second plurality of gaming machines to start executing the fourth game theme and start displaying the fourth game theme skin.

The method may also involve these steps: receiving a fifth indication to change a second environment of the second plurality of gaming machines from a third game theme environment to a fourth game theme environment; and changing the second environment from the third game theme environment to the fourth game theme environment. The first environment may or may not be proximate the second environment.

The invention also provides various other methods and devices for creating and controlling gaming environments. One such device is a gaming environment controller that is configured for determining that a first plurality of gaming machines will stop executing a first game theme and start executing a second game theme. The gaming environment controller may also be configured for changing an audio environment from a first game theme environment to a second game theme environment.

The gaming environment controller is also configured for changing a first display at or near the first plurality of gaming machines from a first game theme display to a second game theme display. The displays may be controlled via a light projection system and/or configurable surfaces, e.g., one or more display screens, one or more electronic paper surfaces, etc. The display may comprise a wall display, a ceiling display and/or a floor display.

The display may be an integrated display spanning multiple surfaces. In some such implementations, the gaming environment controller can cause a single image to span multiple surfaces of the integrated display and/or cause images to move across multiple surfaces of the integrated display. The multiple surfaces may comprise at least one wall surface, at least one floor surface and/or at least one ceiling surface.

Some embodiments of the invention apply to table games, which may be stand-alone or networked table games. One such embodiment provides a table for providing table games. The table includes the following elements: a support structure; at least one logic device; means for receiving an indication regarding a table game theme and providing the indication to at least one logic device; and a configurable display surface on the support structure for displaying information necessary for playing a table game according to instructions from the logic device.

The receiving means may comprise, e.g., a network interface and/or a user interface. In some preferred implementations of the table, the configurable display surface comprises electronic paper.

The present invention provides hardware (such as gaming machines, network devices and components of such devices) that is configured to perform the methods of the invention, as well as software to control devices to perform these and other methods.

These and other features of the present invention will be presented in more detail in the following detailed description of the invention and the associated figures.

DETAILED DESCRIPTION OF THE INVENTION

In this application, numerous specific details are set forth in order to provide a thorough understanding of the present invention. For example, in the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting. The present invention may be practiced without some or all of these specific details. In other instances, well known process steps have not been described in detail in order not to obscure the present invention. Other applications are possible, such that the following examples should not be taken as definitive or limiting either in scope or setting. Other embodiments may be used and changes may be made without departing from the spirit and scope of the invention. Although the following discussion and illustrative examples are directed primarily to casino and gaming machine display devices and systems, it should be borne in mind that these and other similar devices and systems can also be applied and used in other types of establishments, venues and devices.

Figure 1:
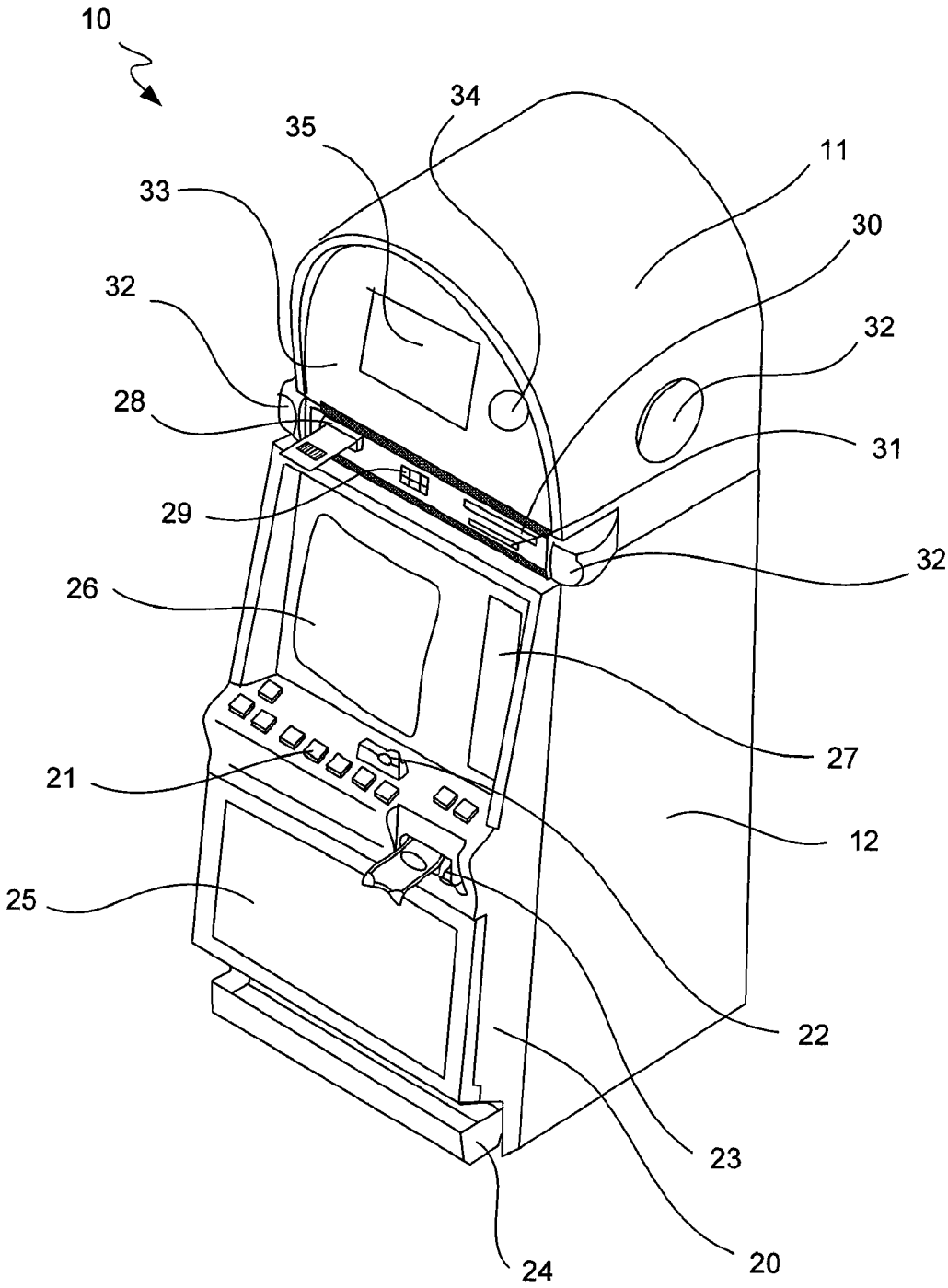
FIG. 1 illustrates in perspective view an exemplary gaming machine.

Continuing with the illustrative example of devices and methods employed within a casino or other gaming establishment, an exemplary gaming machine is illustrated in perspective view in FIG. 1. Gaming machine 10, which is a gaming device that is generally adapted for accepting wagers and granting monetary awards, includes main cabinet 12, which generally surrounds the machine interior (not shown) and is viewable by users. Main cabinet 12 includes a main door 20 on the front of the machine, which opens to provide access to the interior of the machine. Attached to the main door are typically one or more player-input switches or buttons 21, one or more money or credit acceptors, such as a coin acceptor 22, and a bill or ticket validator 23, a coin tray 24, and a belly glass 25. Viewable through main door 20 is a primary video display monitor 26 and one or more informational side panels or side panel glasses 27. The primary video display monitor 26 can generally be used for presenting a main game and other pertinent information, and will typically be a CRT, high resolution flat-panel LCD, plasma/LED display or other conventional electronically controlled video monitor.

Top box 11, which typically rests atop of the main cabinet 12, may contain a ticket printer 28, a keypad 29, one or more additional displays 30, a card reader 31, one or more speakers 32, and a top glass 33. In addition, top box 11 may also contain items situated within the top glass 33, such as one or more cameras 34, and one or more secondary video display monitors 35, which can generally be used for presenting a secondary or bonus game, ancillary information, pay tables, artwork and/or advertisements, and which may also be a CRT, high resolution flat-panel LCD, plasma/LED display or other conventional electronically controlled video monitor. One example of a use and description for a secondary or additional display associated with a gaming machine is disclosed in commonly assigned U.S. Pat. No. 6,315,666 to Mastera, et al., entitled "Gaming Machines Having Secondary Display for Providing Video Content," which patent is incorporated herein in its entirety and for all purposes. While the foregoing example places various gaming machine items and peripherals in specific locations for purposes of illustration, it is generally understood that all illustrated items may not be present on every gaming machine, that all such items can be located in different places on or about the machine, and that other items and peripherals, such as a top box diorama, for example, can also be present.

Figure 2:
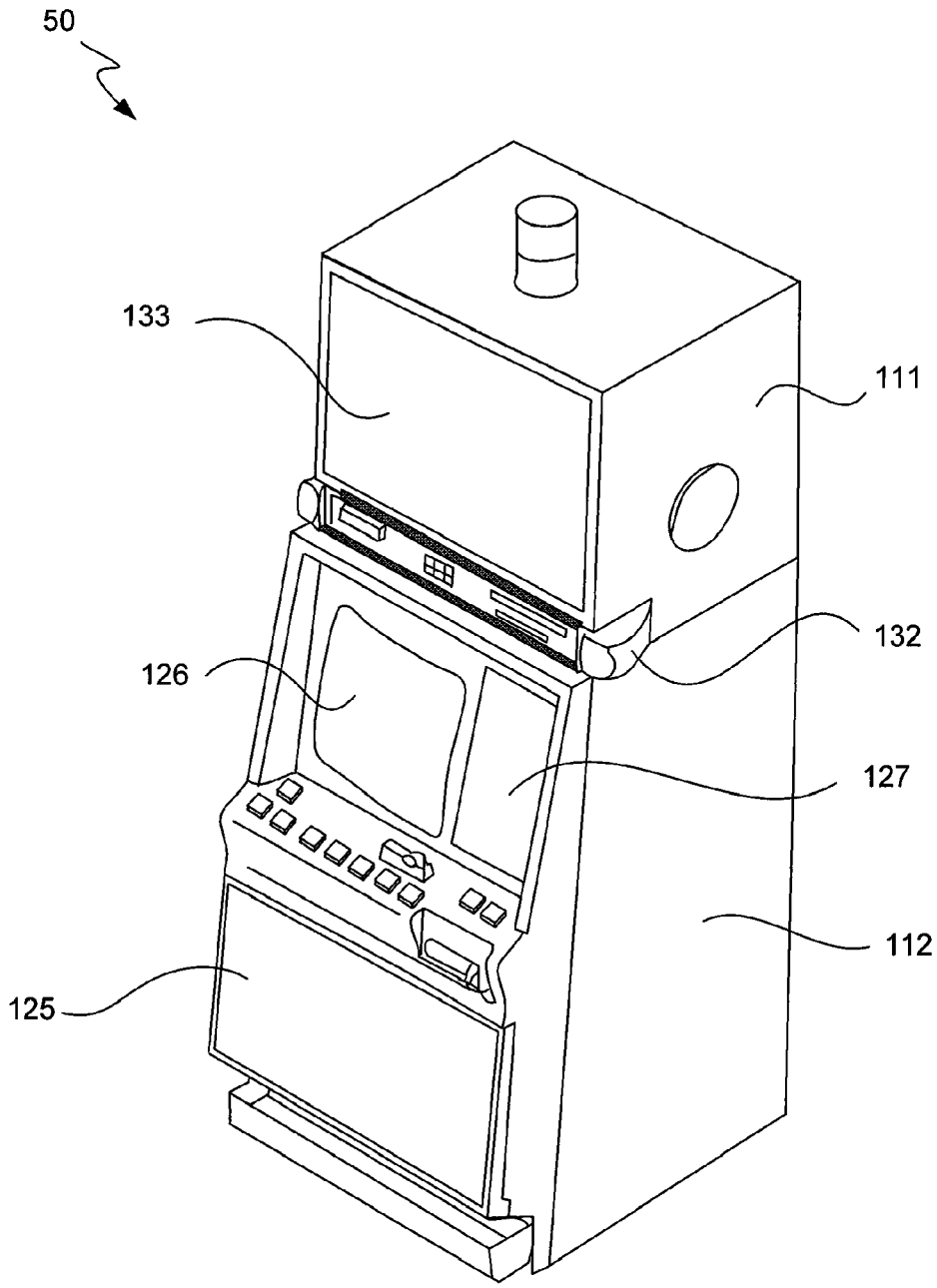
FIG. 2 illustrates in perspective view an alternative gaming machine according to one embodiment of the present invention.

With reference to FIG. 2, an alternative gaming machine according to one embodiment of the present invention is illustrated in perspective view. Similar to the previous gaming machine 10 of FIG. 1, alternative gaming machine 50 is also a gaming device that is generally adapted for accepting wagers and granting monetary awards. Although alternative gaming machine 50 is generally more box-like than the previous gaming machine 10 of FIG. 1, such a difference is considered insubstantial for purposes of the present invention. In fact, it is specifically contemplated that every inventive embodiment disclosed herein can be used in conjunction with all gaming machines of any shape or size, with appropriate adaptations or adjustments made as necessary. As in the previous example, gaming machine 50 includes a top box 111 and a main cabinet 112, both of which have a number of features substantially similar to those found in the previous gaming machine, such as a primary video display monitor 126 and one or more speakers 132.

Gaming machine 50 also includes one or more automatically configurable devices and/or portions, which will often be referred to herein as "configurable surfaces" or the like. Some such configurable surfaces are essentially peripheral auxiliary video display units in communication with one or more logic devices, such as the MGC or another processor. However, as discussed in detail below, in some embodiments of the invention, one or more configurable surfaces are formed of electronic paper or the like. In this example, main cabinet 112 features a configurable belly surface 125 and a configurable side surface 127, instead of a traditional silk-screened or otherwise statically labeled belly glass and side glass. In addition, top box 111 features a configurable top surface 133 rather than a traditional silk-screened top glass or otherwise static label.

Although configurable surfaces are shown in three separate places here, it is specifically contemplated that fewer or more configurable surfaces can be used in any combination as desired in a given instance. Moreover, in some implementations of the invention, other locations on and about the gaming machine or other device can be adapted for use with a configurable surface. For example, one or more walls, a portion of a floor or ceiling, signs, etc., may include a configurable surface. In some such embodiments, a display indicated on such a configurable surface will correspond with a game theme, a group, a team etc. Such displays may also include audio and/or projected light, as described in more detail below. Furthermore, each configurable surface can vary in size and shape as needed to conform to whatever physical specifications may be necessary.

In some embodiments of the invention, at least one configurable surface comprises a video display device that can be used for presenting a potentially infinite assortment of visual displays, such as, for example, a main game, a copy of a main game, a bonus game, animated or static pictures or artwork including game related themes, video clips, advertisements, pay tables, other pertinent information and any other visual display presentation. The actual video display device can be selected from any of a number of different video display types, including, by way of example, any standard LED, LCD or CRT, a "thin" CRT, a high resolution flat-panel LCD, a plasma display, a field emission display, a digital micromirror device, and any other electronically controlled video monitor, as well as a hologram or any other three-dimensional projected imaging device. In addition, such a display device used as a configurable surface may be adapted for use as an input-accepting device, such as a touch screen, if desired. One example of such a touch screen or other interactive display device used in connection with a gaming machine is disclosed in commonly assigned and co-pending U.S. patent application Ser. No. 10/139,801, by Winans, et al., filed May 3, 2002, and entitled "Light Emitting Interface Displays for a Gaming Machine," which application is incorporated herein in its entirety and for all purposes.

Each configurable surface may also comprise or be associated with one or more additional speakers, microprocessors or other electronic components, as discussed in greater detail below. For example, in embodiments wherein electronic paper or the like is used as a configurable surface, one or more speakers may be positioned behind the configurable surface. In some such embodiments, at least a portion of the speaker itself may be formed from, or at least covered by, electronic paper.

Unlike the secondary or other auxiliary gaming machine video displays disclosed in commonly assigned U.S. Pat. No. 6,315,666, some preferred embodiments of configurable surfaces in the present invention are not event-driven media-slave type devices that require a substantial amount of separate and independent memory or storage. Rather, each configurable surface is preferably media-driven, such that all presented images and other display materials are not permanently stored on the configurable surface, but instead are delivered by a logic device to the configurable surface for display. In this manner, it is not necessary for a configurable surface to have a substantial amount of associated ROM, flash RAM, dynamic RAM or other associated electronic storage, as would be required for an event-driven, media-slave video display device. Because such a configurable surface is media-driven rather than event-driven, it is also unnecessary for a controlling MGC or other associated logic device to regularly communicate state information and event commands to the configurable surface. In fact, in one embodiment it is specifically contemplated that a given static image substantially resembling a traditional silk-screened glass be sent one time to a configurable surface by an associated logic device, whereupon that static image is stored in the configurable surface by a relatively small flash RAM or dynamic RAM unit, and then repeatedly displayed on the configurable surface, thus becoming a virtual silk-screened image. When electronic paper is used to form a configurable surface, such a static images does not need to be displayed repeatedly, because the display state is stable even if power is removed.

Figure 3:
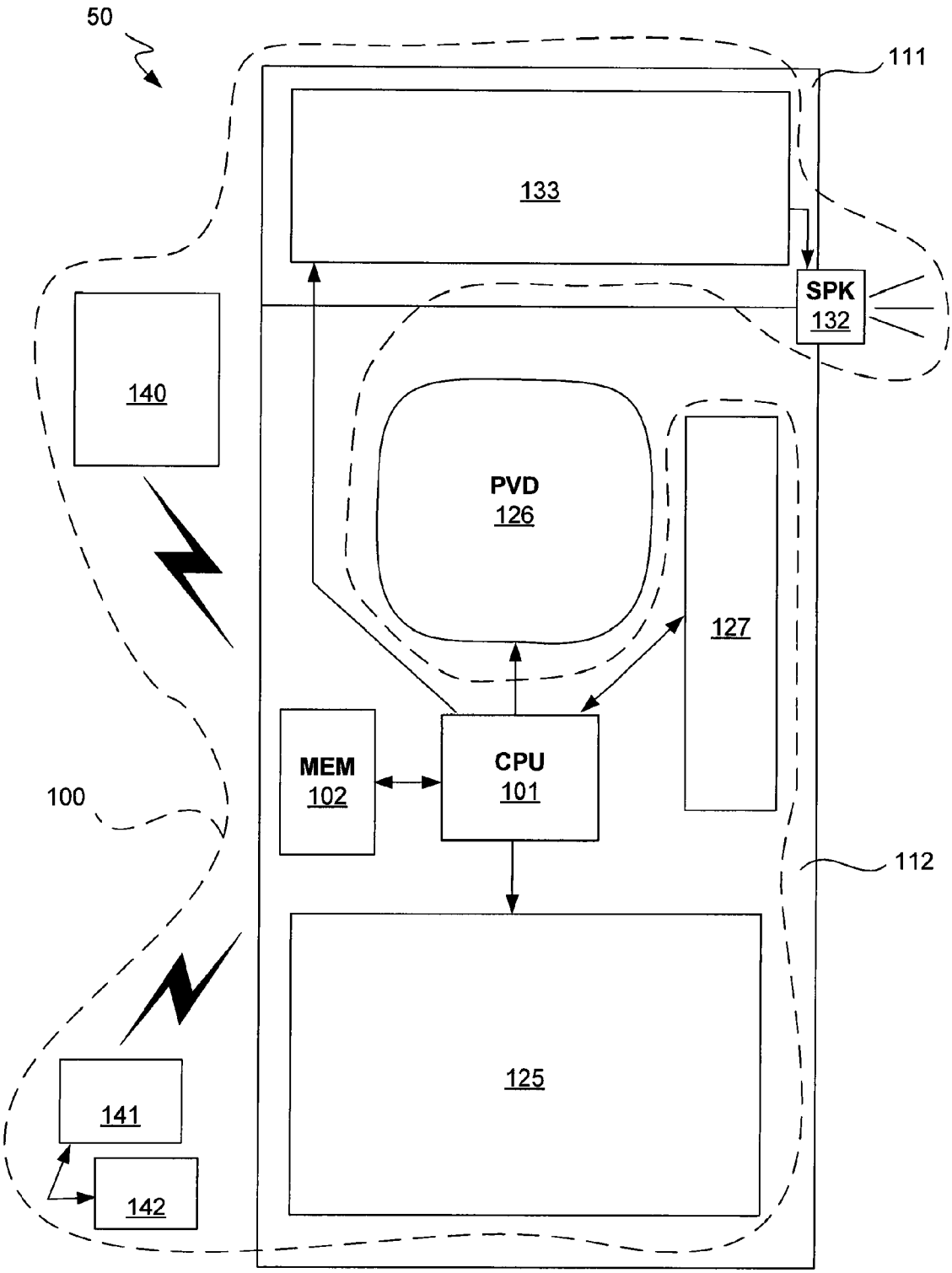
FIG. 3 illustrates a block diagram of an exemplary electronic component infrastructure for generating and controlling video displays in a gaming machine according to one embodiment of the present invention.

Turning now to FIG. 3, a block diagram of an exemplary electronic component infrastructure for generating and controlling video displays in and around a gaming machine according to one embodiment of the present invention is illustrated. Configurable surface display system 100, which generally resides within and/or about gaming machine 50, comprises a plurality of components, each of which are separate and distinct from the primary CPU or MGC 101. Such a primary CPU or MGC 101 can be, for example, a model i960 type of CPU, manufactured by Intel Corporation of Santa Clara, Calif., which model is present in many gaming machines manufactured by IGT of Reno, Nev., such as many of those under the Game King and Vision labels, as well as various other electronic gaming machines.

In fact, i960 type and similar types and variations of CPUs are present in many types of electronic gaming machines, and inclusion of not only i960s but all types and variations of CPUs are contemplated for use in the present invention. For example, many of IGT's electronic gaming machines include an Intel® Pentium® or Celeron® CPU, e.g., a Pentium III®. CPU 101 is generally responsible for controlling and/or processing all elements of game play, money or credit intake, payouts, driving auxiliary peripherals, any network communications (if applicable), and other machine functions, as is generally known in the art.

CPU 101, which is the MGC for gaming machine 50, is preferably placed in communication with one or more associated storage units 102, which storage units may comprise ROM, RAM, static RAM or any other practicable type of memory or data storage, or any combination thereof. In addition, one or more memory units 102 may reside directly in or on CPU 101, or may be separate and in communication with the CPU, and may comprise, for example, a hard disk, a disk drive, a flash drive or any other type of data storage hardware unit. Since it is the MGC of the gaming machine, CPU 101 is preferably also the driver for a primary video display ("PVD") monitor 126, with this primary display monitor being used to present at least a main game and result, among other display information and items. Although possible in some instances, PVD 126 is generally considered not to be a good candidate for a configurable surface, due to its substantially different nature from other displays with respect to at least some display contents and in its relationship to the MGC and game in general. Accordingly, PVD 126 is not a configurable surface in the present example and is not considered to be a part of the configurable surface display system 100 as illustrated.

As disclosed previously, CPU 101 (i.e., the MGC) is preferably associated with one or more configurable surfaces within gaming machine 50, such as configurable belly surface 125, configurable side panel surface 127 and configurable top surface 133. In the present example, CPU 101 is in communication with each configurable surface 125, 127, 133, and under such an arrangement this MGC is considered to be a "host" for each configurable surface, with the host being responsible for sending any and all images, animations, video clips, sounds and other materials that the host wants displayed by a configurable surface. Although it is entirely possible for fewer or more configurable surfaces to be included in a given gaming machine, as disclosed previously, it is also possible for one or more hosts to be associated with a given gaming machine at any one time. In fact, a plurality of different hosts can be within and/or outside the gaming machine, as discussed in greater detail below, although the present focus will remain on just the MGC as a host for now. While communication thus obviously occurs from the MGC host to each configurable surface, in some cases it may also be desirable for communication to proceed from a configurable surface back to the MGC, such as, for example, where VSG 127 can be an input accepting touch screen type of display, whereupon it is then necessary for input made at the touch screen to be relayed back to the MGC for processing.

As discussed in greater detail below, each configurable surface preferably comprises a few basic electronic components, including at least one simple processor or programmable logic device ("PLD") and at least one relatively small memory or storage unit, such as a flash RAM or dynamic RAM, capable of temporarily storing at least one static image, display file or other set of display related data. Such a static image file or set of display related data can then be accessed repeatedly by the processor once it is so stored, such that the host must send any particular static image file or set of data only once for that image or related display to be displayed constantly for an indefinite period of time.

In one exemplary mode of operation, a configurable surface receives a static image file from the issuing host, temporarily stores that static image file in a low capacity flash RAM unit, and then repeatedly reads that static image file and casts the image contained therein onto the configurable surface at least until another image file is stored in the flash RAM unit and/or the configurable surface is otherwise ordered to stop displaying its flash RAM contents. Again, for configurable surfaces implemented with electronic paper or the like, it is not necessary to read a static image file and cast the image on the configurable surface repeatedly. A static image displayed on electronic paper should not need to be refreshed for a matter of hours or even days.

In a particular example of static image files or data sets being sent to the various configurable surfaces, a player may select one from a variety of game choices on a given multi-game machine, whereupon the MGC, which is also the host CPU 101, sends to each configurable surface a file or data set for a static graphical art thematic image reflective of that particular player selected game. Such a game can be an "Elvis" or "Star Wars" themed game, for example, both of which can then be made available on the same gaming machine. During the entire time that the player plays that selected game on that gaming machine, each configurable surface displays its stored static thematic image reflective of that game, resulting in constant visual displays that essentially emulate traditional thematic silk-screened glasses. Because the MGC sends each image just once and is then no longer involved with driving or monitoring each configurable surface display during game play, an enormous amount of machine resources and MGC activity are advantageously saved, with such resources and MGC activity then being available for other processes or enhance primary game features.

A new image or video display can be sent to one or more configurable surfaces for any number of reasons. A player may choose to select a different game, for example, whereupon the host MGC can then send files or data sets for static graphical art thematic images reflective of that newly selected game to each configurable surface for constant display in the same manner detailed above. Alternatively, the game theme for a group of gaming machines may be changed by a casino operator and/or according to a predetermined schedule. Such game theme changes may be conducted, for example, as described in the SBG Application.

Alternatively, if game play should stop for a given period of time, the host MGC may be programmed to send a separate set of image files or data sets to each configurable surface on its own. In this manner, a multi-game machine can be programmed to automatically rotate complete sets of configurable surface displays for many or all of the various possible games and themes available on that machine during a player attract phase or other similar down time. It is also contemplated that a wide variety of other video image files or data sets can be sent to a configurable surface to display for either an indefinite or set period of time, with such images including, for example, pay tables, other machine information, general casino and hotel information, other advertising, copies of recent main game results, and screen images of recent jackpot wins, among others.

In addition, other types of video displays that can be accommodated by the flash RAM or dynamic RAM capacity of a given device are also contemplated, with examples including multiple frame animations and short video clips. In some such embodiments, due to the limited storage constraints of the associated flash RAM or dynamic RAM, the length of a video clip is effectively constrained by its resolution, with a high-resolution clip being relatively short if the available memory is relatively small.

Finally, it is also contemplated that the video display device for some types of configurable surfaces may also be utilized separately for different modes of operation, such as for a primary game display, a copy of a primary game display, or for displaying a direct feed of live or taped video, for example. Depending on the capabilities of the MGC and the available memory, such embodiments may or may not be desirable, in that increased MGC load becomes necessary and/or one or more additional independent inputs to the configurable surface display device would likely be required. It is anticipated that as multi-core processors, larger-capacity memories and/or more advanced versions of electronic paper are deployed, such operational modes may become more desirable. For the time being, however, the availability of such different modes of operation is simply considered to be an alternative feature of the standard configurable surface operational mode.

Referring again to FIG. 3, each configurable surface may be associated with one or more speakers 132, with such associations being either exclusive for a given configurable surface, or shared with other configurable surfaces and/or other machine components. For example, while speaker 132 is clearly associated with configurable surface 133 in the present illustrative example, it is also possible that CPU 101 can have a direct connection (not shown) with this speaker in order for this acting MGC to provide separate and independent audio display content and commands. In this manner, configurable surface 133 can issue audio content related to its video display content to this speaker 132, while CPU 101 is also able to issue separate audio content to the speaker. Speaker 132 may be programmed to recognize and prefer one audio content issuing device over another, or may contain a simple PLD to process, queue and resolve conflicting audio commands by a predetermined priority or other similar method, such a practice as will be readily understood by those skilled in the art.

Configurable surface display system 100 may also comprise one or more associated remote units, such as remote configurable surface 140 and remote host ("RH") 141, with such remote units being those that are not contained within the gaming machine itself. Configurable surface 140 may operate much like any other configurable surface within gaming machine 50, and may be in communication with at least one host associated with the gaming machine, such as CPU 101 or any other additional internal host (not shown). RH 141 operates much like CPU 101 or any other internal host with respect to one or more associated configurable surfaces, with RH 141 or any such additional internal host preferably having access to one or more associated configurable surfaces 125, 127, 133, 140. Any such additional host preferably comprises a processing unit and at least one associated or accessible memory or storage unit, such as remote host memory ("RHM") 142.

Any number of associated remote units such as configurable surface 140 or RH 141 may reside in a variety of locations, such as attached to any outside portion of the gaming machine, nearby but above, below or next to the gaming machine, and/or remotely located from the gaming machine at some distance, as desired. For example, configurable surface 140 may be a wall surface, a ceiling surface, a floor surface or the surface of a sign or poster. As described in more detail below, forming configurable surface 140 from electronic paper can allow relatively large areas of such surfaces to form a display. In fact, a remote unit may reside in a different room, a different building or even a different city from an associated gaming machine, as permitted by the communication means and protocols used.

Communication means and protocols for both internal and remote configurable surface units can vary widely as desired, with one exemplary use and description for standard peripheral communications within a gaming machine being disclosed in commonly assigned U.S. Pat. No. 6,251,014 to Stockdale, et al., entitled "Standard Peripheral Communication," which patent is incorporated herein in its entirety and for all purposes. Configurable surface communications can be made both internally within a single machine, or alternatively over a network of machines and/or servers, such as a WAN or LAN, for example. Hard-wired types of communications and protocols that can run between machines, devices and servers can include, for example, those involving Universal Serial Bus ("USB"), Firewire and proprietary cables and bus technologies.

In a preferred embodiment, one or more configurable surface units are adapted to implement a communication protocol that allows such configurable surfaces to be identified by the master gaming controller of an associated gaming machine as a device authorized to connect to the master gaming controller, particularly where the configurable surface also comprises a source of player input, such as in the case of a touch screen. Particular examples of such USB software, connections and protocol usage in devices within and associated with gaming machines are disclosed in commonly assigned and co-pending U.S. patent application Ser. No. 10/460,822, by Lam, et al., entitled "USB Software Architecture in a Gaming Machine;" Ser. No. 10/460,826, by Quraishi, et al., entitled "Protocols and Standards for USB Peripheral Communications;" and Ser. No. 10/460,608, by Quraishi, et al., entitled "Download Procedure for Peripheral Devices," all of which were filed Jun. 11, 2003, and all of which are incorporated herein in their entirety and for all purposes.

Alternatively, any practicable wireless technology may also be implemented for communications between a host and configurable surface, including, for example, a Bluetooth® Wireless system utilizing an IEEE 802.1x standard, an alternative wireless system utilizing a similar wireless fidelity ("Wi-Fi") standard, and any other system having standard wireless communication means and protocols. Exemplary systems and methods of providing and receiving wireless communications between various devices within and associated with a gaming machine are disclosed in commonly assigned and co-pending U.S. patent application Ser. No. 10/661,404, by Silva, et al., filed Sep. 11, 2003, and entitled "Wireless Input/Output and Peripheral Devices on a Gaming Machine," which application is also incorporated herein in its entirety and for all purposes.

Figure 4:
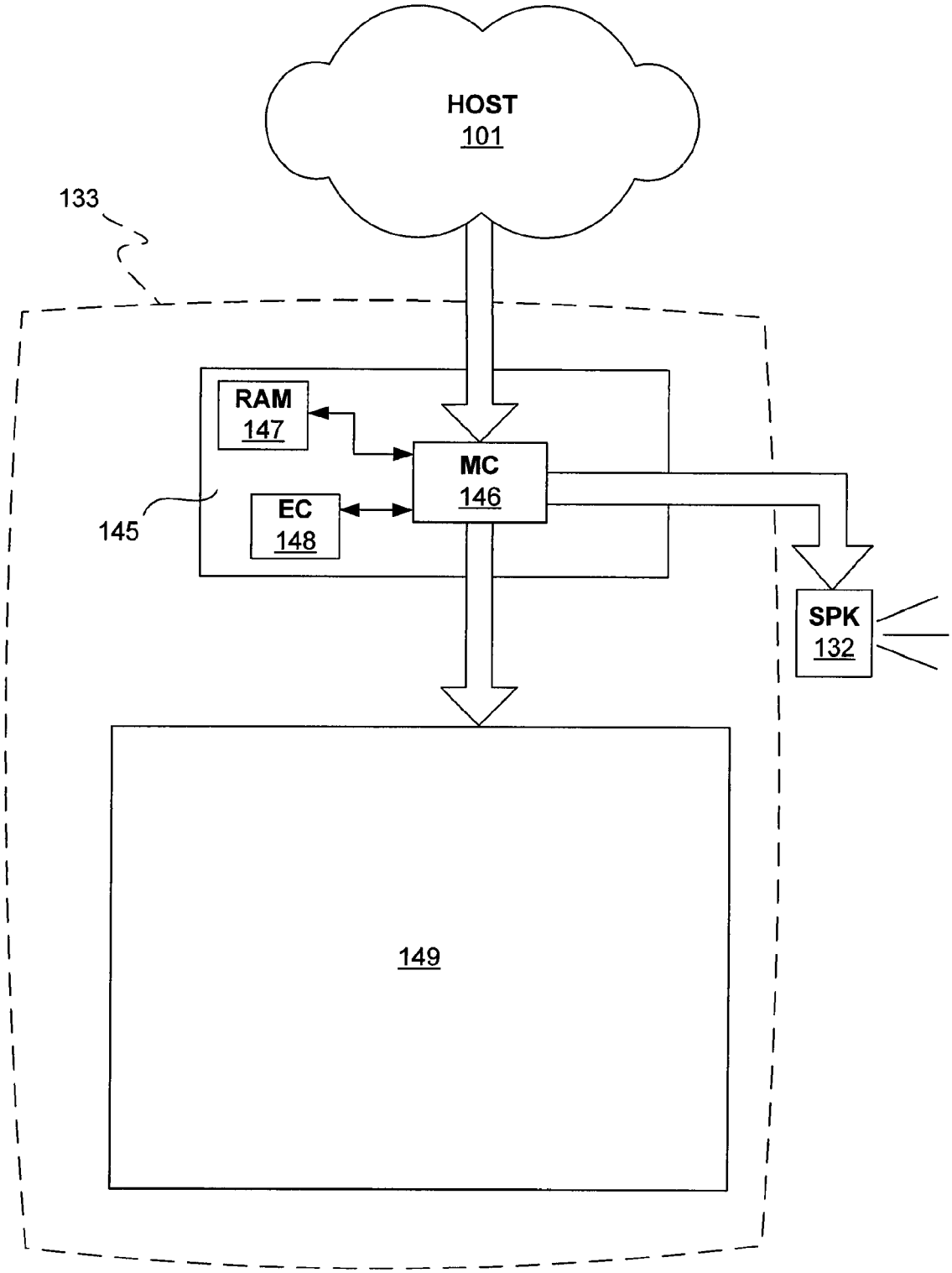
FIG. 4 illustrates a block diagram of an exemplary configurable surface unit according to one embodiment of the present invention.

Turning now to FIG. 4, an exemplary configurable surface according to one embodiment of the present invention is illustrated in block diagram format. Configurable surface 133, which is substantially identical to configurable surface 133 of FIG. 3, receives input from a host 101 and provides display outputs to a configurable surface monitor 149, which is considered to be part of the configurable surface, and/or an associated speaker 132. Inputs are first received and acted upon by the configurable surface by one or more electronic components on a printed circuit board ("PCB") 145 or other like organizing device. In one simple embodiment, a microprocessor component ("MC") 146 or other like logic device first receives the image, video file or other display related data set issued by a host, and in turn stores the data onto an associated storage device or memory unit, such as flash RAM 147. A video controller, which may be a part of MC 146, then repeatedly reads the file or data set stored in flash RAM 147 and forwards the image contained therein to be displayed on configurable surface monitor 149 until the configurable surface is given another set of display data or otherwise instructed to stop displaying on the configurable surface. Alternatively, the video controller may be a separate device distinct from the MC 146 or other like logic device. Such an arrangement may be desirable due to design preferences, cost considerations, availability of off-the-shelf parts and other factors.

Hence, a configurable surface monitor system has at least one host adapted to present video content to a configurable surface, at least one host memory unit or other storage device in communication with the host and adapted to store video content accessible to the host, and at least one configurable surface in communication with the host. A standard configurable surface, then, has at least one logic device, at least one storage unit and one video display device. In some embodiments, the configurable surface storage units are so small that the combined capacity of all configurable surface storage units is substantially less than the combined video content capacity of all host storage units. While flash RAM 147 has a limited memory capacity, such that configurable surface 133 is simple and streamlined in comparison with other conventional secondary video display peripherals, the existence of this flash RAM or a similar memory or storage component is vital for some types of configurable surfaces to function as a closed loop type of repeating image display.

In one embodiment, flash RAM 147 is preferably designed such that it can be overwritten with new files or data sets on command, but such that a given data set, file or series of files (such as for a multi-frame animation) remain in memory or storage until they are erased, overwritten, or otherwise formatted away. Flash RAM 147 is hence nonvolatile enough to retain a stored image file or data set in the event that a machine shutdown or other irregular event occurs. While such a file or data set may be singularly small, preservation of such a small amount of video data may be critical in some instances.

For example, a gaming machine may be programmed to send a screen shot or series of screen shots to one or more configurable surface when any significant jackpot occurs in a main game on a gaming machine. In the event that a machine shutdown or malfunction occurs after the jackpot, the flash RAMs of one or more configurable surfaces can be used to recall screen shots involved in a purported jackpot. Exemplary uses and descriptions for preserving and playing back a game history for a gaming machine, and for presenting game history frames at locations at alternative locations within and outside a gaming machine are disclosed in commonly assigned and co-pending U.S. patent application Ser. No. 09/689,498 by LeMay, et al., filed Oct. 11, 2000, and entitled "Frame Buffer Capture of Actual Game Play," which application is incorporated herein in its entirety and for all purposes.

Because the static nature of RAM 147 is not critical for all configurable surface implementations, however, other forms of storage may also be used. For example, RAM 147 may comprise a dynamic RAM device that does not retain files or data in memory or storage upon a shut down or power outage. While the loss of any stored data may be disadvantageous in some instances, relatively cheaper dynamic RAM units may be desirable where the preservation of such stored data in the configurable surface itself is not deemed to be important. In such instances, it is specifically contemplated that any lost images due to shut down or power outages can simply be resent to an affected configurable surface by an appropriate associated host. Moreover, as mentioned elsewhere herein, some types of configurable surface (such as electronic paper and the like) will retain a displayed image even when power is interrupted.

In a more advanced embodiment, one or more additional electronic components ("ECs") 148 within the configurable surface may be desired. Such an additional EC could be, for example, a separate video controller, an added processor, a PLD, a field programmable gate array or an added flash RAM or dynamic RAM unit capable of storing one or more added video files or data sets, among others. As illustrated, EC 148 simply represents an additional flash RAM unit, such that configurable surface 133 is capable of temporarily storing video files or data sets in two different associated places at one time, which can be advantageous for a number of reasons. In one particular example involving two separate and independent video displays for one configurable surface, a Mega Jackpot amount or other pertinent information can be displayed on a configurable surface in an overlaid or embedded fashion within a separate, dominant static image for that same configurable surface. Other EC types may require different PCB configurations, such as, for example, a simple PLD used as a buffer unit between the host 101 and MC 146, with the PLD being connected to both the flash RAM 147 and MC 146.

Alternatively, it may be desirable to have an advanced MC or one or more additional specialized microprocessors, depending on various added functionalities that may be desirable for a particular configurable surface. For example, it may be desirable for a particular configurable surface to be able to display a series of frames in an animation-like sequence, decompress files issued in a compressed format, and/or be able to scale images depending on image size variances with respect to display space. It may also be desirable for a configurable surface to have anti-aliasing algorithms and abilities and/or be able to buffer multiple images from multiple media types. Other desirable traits may include the ability to execute scripts, such as Java® or any other proprietary script, for use with input accepting touch screens, and/or the ability to render issued 3-D images into 2-D images, such as through the use of Virtual Reality Modeling Language ("VRML"). Exemplary systems and methods for rendering and providing 3-D images in a gaming machine are disclosed in commonly assigned and co-pending U.S. patent application Ser. No. 09/927,901, by LeMay, et al., filed Aug. 8, 2001, and entitled "Virtual Cameras and 3-D Gaming Environments in a Gaming Machine," which application is incorporated herein in its entirety and for all purposes. In any of the foregoing instances, a digital signal processor ("DSP") or other like device may be a desirable additional EC within the configurable surface.

While one or more such added ECs can certainly be utilized, it should be remembered however that one desirable feature of some configurable surfaces is to provide added visual displays having a low amount of memory or storage, simpler processing units and less accompanying infrastructure. With the need to continuously drive one or more auxiliary video displays eliminated, the overall workload on a main processor board, MGC, and other associated hardware is substantially reduced. With no need to waste MGC cycles to repeatedly service static images being used to replace glass art, there is less demand on the central processing assembly, which in turn reduces heat and other undesirable effects of an overburdened MGC. It is preferable that at least some advantages realized by a less burdened MGC also be realized in a streamlined, low space, low power and low cost configurable surface. It is thus preferable that added ECs and other structures to a given configurable surface be minimal in nature. Accordingly, it may be desirable that any necessary heavy processing work, such as a 3-D to 2-D rendering, be done by a host or other outside processor, such that the data is simply transferred to the configurable surface for presentation, thereby minimizing the number and complexity of processors and components associated with the configurable surface as much as possible.

Should such added processing work be regularly expected, however, it may be desirable to specifically include a separate processor as a configurable surface host for a gaming machine, such that the MGC is not unnecessarily overburdened. In fact, it is specifically contemplated that a plurality of both internal and external configurable surface hosts be associated with a given gaming machine. Such hosts may be related, such as on a particular gaming machine network. Some examples of using related hosts to create a group gaming experience and/or an immersive environment will be discussed in more detail below.

Alternatively, the hosts may be fully separate and independent from each other. For example, one host may be the gaming machine MGC, while another may be a remote autonomous host that issues advertisements for a casino or hotel to various configurable surfaces, with such video data specific to an establishment operating the gaming machine being stored on an associated host memory or storage unit. One desirable effect of utilizing multiple hosts in association with a given configurable surface is that video images, clips and other files and data sets can be more readily stored in a plurality of locations within and outside a gaming machine or remote configurable surface.

Figure 5:
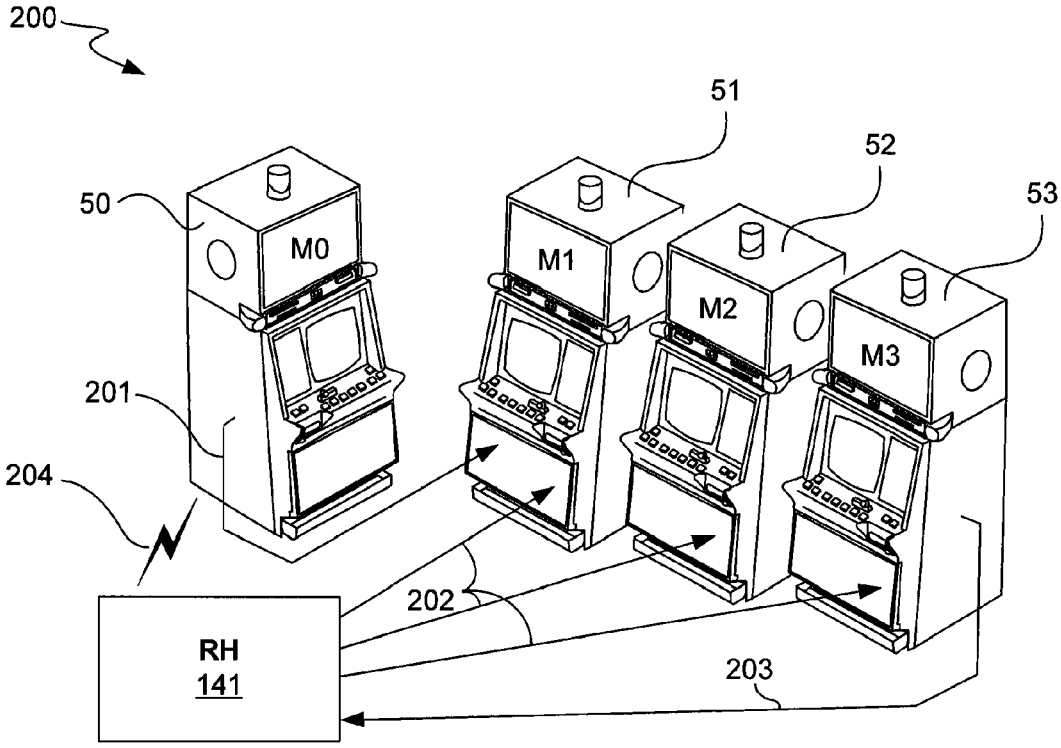
FIG. 5 illustrates a block diagram of an exemplary gaming machine network for providing networked configurable surfaces according to one embodiment of the present invention.

Turning to FIG. 5, a block diagram of an exemplary gaming machine network for providing networked configurable surfaces is illustrated. Gaming machine network 200 comprises a plurality of gaming machines 50-53 and at least one RH 141, which can be, for example, a primary server or other configurable surface master host. A primary gaming machine ("M0") 50 can be in direct communication with at least a first separate gaming machine ("M1") 51, such that M0 can function as a host for one or more configurable surface in M1. Such communication from M0 to M1 can occur over, for example, a hard-wired communication line 201. In addition, the RH 141 serves as a remote host to configurable surface in each of M1 50, a second separate gaming machine ("M2") 52 and a third separate gaming machine ("M3") 53, with appropriate video content being sent to the various configurable surfaces in each machine via hard-wired communication lines 202. Because it may be desirable for hosts within one or more gaming machines to provide content to other machines directly or via an intermediary conduit such as RH 141, each machine may have return communication abilities with RH 141, such as hard-wired connection 203 from M3 53. Wireless communications between the various remote hosts and configurable surfaces may also be available if desired, such as the wireless two-way communication 204 provided between M0 50 and the remote host 141. Of course, added communications from more hosts to more configurable surfaces are also possible, such that every host within network 200 can potentially be associated with every configurable surface in the network.

As seen from this example, each gaming machine in a given bank or grouping of machines can potentially be a host for one or more configurable surfaces in some or all of the other machines in that group. In such an arrangement it may be desirable to display, for example, a current jackpot or other immediately vital information from one gaming machine on at least one configurable surface of every machine in that group. Such implementations are particularly useful in group gaming scenarios, some examples of which will be discussed below.

Alternatively, it may be desirable for a remote host to utilize some or all associated configurable surfaces in many associated machines in another helpful manner. For example, a given group of configurable surfaces can be utilized to assist with providing directions for a casino guest. In such an instance, a command to provide directional help from a front desk to a particular buffet can be issued from an employee to a networked system having a master remote host. A series of configurable surfaces can then provide arrows or other indicative displays sequentially as the guest proceeds from the front desk to the buffet or other desired destination within the establishment.

Figure 6:
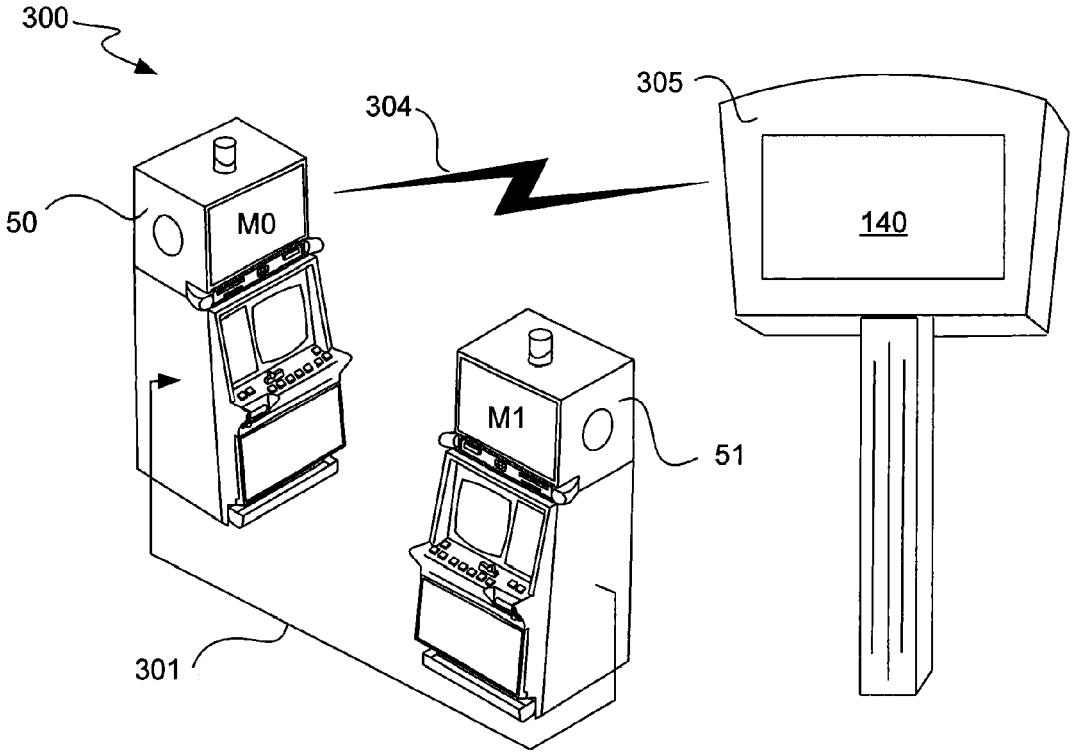
FIG. 6 illustrates a block diagram of an alternative exemplary gaming machine network for providing networked configurable surfaces according to another embodiment of the present invention.

Referring now to FIG. 6, a block diagram of an alternative or additional portion of an exemplary gaming machine network for providing networked configurable surfaces is illustrated. As in the foregoing embodiment, a gaming machine network 300 comprises a plurality of gaming machines, such as a primary gaming machine ("M0") 50 and at least one separate gaming machine ("M1") 51. Network 300 also comprises a remote configurable surface 140, which can be, for example, a marquee display on a casino floor, an associated hotel or restaurant lobby, a wall surface, a floor surface, a ceiling surface, a sign or poster within a casino or on a sign outside the casino.

Configurable surface 140 could also comprise a carousel display for displaying a Megabucks Jackpot or other information for a bank of gaming machines, whereupon a single gaming machine 50 could act as a primary host for the carousel display bank, eliminating the need for additional carousel related equipment. Configurable surface 140 can thus be associated with multiple hosts, or may be connected for restricted control purposes to only a single host, such as M0 50. Again, communications between a host M0 50 and configurable surface 140 can be through any practicable means desired, such as a hard-wired or wireless connection 304. Should another associated gaming machine, such as M1 51, desire to forward video contents for display on configurable surface 140, it may be necessary for the other host or hosts to provide such content indirectly by forwarding to the primary host 50, such as through connection 301. Of course, this connection can also be used as a means for M1 51 being a direct host for one or more configurable surfaces in M0 50.

With the potential for so many hosts being associated with any given configurable surface, it may be preferable to use a logic device such as a PLD or other processor for each configurable surface to prioritize conflicting content from one host over another. Similar to the case of conflicting commands to a speaker above, a processor or PLD can be used to process, queue and resolve multiple commands by multiple hosts by a predetermined priority, or other similar method, such a practice as will be readily understood by those skilled in the art. For example, a first-in first-out ("FIFO") approach can be used, whereby video content is displayed in the order received. Preferably though, the logic device can be programmed to recognize various levels of priority both in hosts and in type of content. For example, a top-level host could be a master remote host, such as a network level primary server for the entire casino, with a local remote host for a particular floor region being next in line, an MGC or other internal CPU for the given machine being next, and remote host MGCs or CPUs within neighboring gaming machines being last. A top priority for video content might be emergency related information, followed by security related information, neighboring jackpot information, immediate game play artwork displays, and finally random advertisements for use during down time.

It is specifically contemplated that at least some of the configurable surface apparatuses disclosed and detailed above can be utilized not only in newly manufactured gaming machines and other electronic components, but can also be implemented into existing gaming machines and other devices by removing various existing components in those machines and devices as necessary. For example, while one or more original video displays may remain in a given machine, such as for primary game play, it is contemplated that at least one configurable surface be installed as a top glass, belly glass or other associated machine display to replace any existing traditional silk-screened glass, secondary video display or other visual display in or about the machine.

In addition, it is also specifically contemplated that the number, shape, size, orientation and planarity of a configurable surface video display device or devices not be limited in any way. For instance, the shape of a configurable surface need not be rectangular, as such configurable surfaces may also be round, ovular, triangular, hexagonal, or shaped in any other way desired, including shapes that form part of the exterior artwork on the gaming machine. In addition, one or more configurable surfaces can be used in combination to form one configurable surface, and such a plurality of configurable surfaces could be linked together to provide a frame around a primary video display screen, such as in a square formation with a "hole" in the middle for the primary screen. Furthermore, it is not necessary that configurable surface video monitors or screens be planar, as such screens can be designed to conform to any surface on the gaming machine as desired. For example, a 360-degree curved configurable surface display made up of one or more curved screens may be located above or adjacent to an associated gaming machine. Alternatively, one or more configurable surfaces may wrap around various types of objects, which is possible with "electronic paper" type configurable surfaces. It is also contemplated that a configurable surface display device can be holographic in nature, such that a conventional "monitor" is not even necessary.

Figure 7:
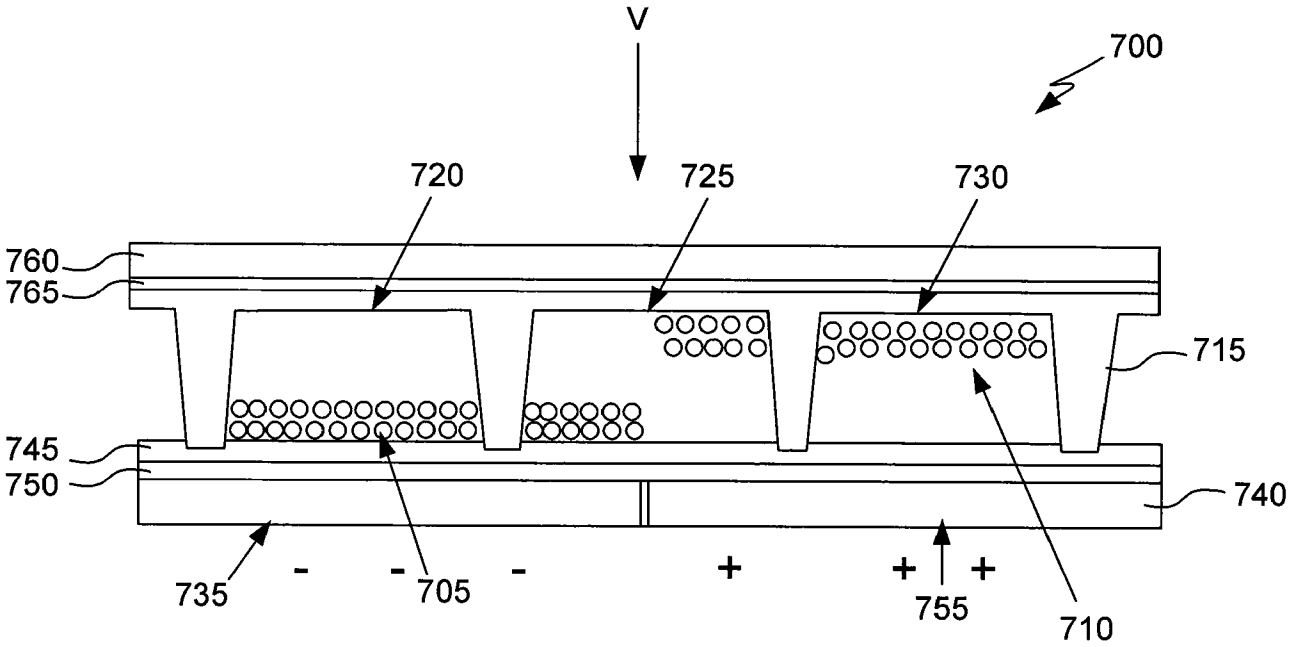
FIG. 7 is a cross-section of electronic paper.

Some such implementations of the invention will now be described with reference to FIG. 7 et seq. Many of these implementations involve at least some configurable surfaces formed from electric paper. Unlike most other display technologies, electronic paper has image memory. In other words, the display content remains after power has been removed. It is sometimes said that the pixels of electronic paper are "bistable," because the state of each pixel can be maintained without a constant supply of power. However, as will be discussed further below, some implementations of electronic paper involve more than two stable (or at least metastable) states.

There are many methods of forming electronic paper. The type that will be described in most detail herein is a form of "electrophoretic" display technology, because it is based on the principles of eletrophoresis (the movement of an electrically charged substance under the influence of an electric field). Other technologies being applied to electronic paper include electrochromic displays, modified versions of liquid crystal displays and cholesteric displays.

Because electronic paper can be formed on a thin, plastic substrate, such embodiments are flexible and can conform to various shapes. However, it can also be advantageous to form electronic paper on a rigid substrate.

Electronic paper is easier to read at an angle than flat screen monitors. Some commercially available electronic paper may purportedly be read over almost a 180 degree range of viewing angles, even when mounted flat. Electronic paper is potentially inexpensive; it is expected that the cost of electronic paper will fall substantially during the coming years.

Some currently-deployed electronic paper achieves Quad-XGA resolution (1536×2048 pixels) and has a contrast ration of 10:1. Accordingly, electronic paper has attained levels of resolution and contrast comparable to those of images printed on ordinary paper. Unlike ordinary paper, however, electronic paper can be electronically reconfigured.

Due to these and other desirable features, low-power configurable surfaces of gaming machines and gaming environments may be created with electronic paper. Turning now to FIG. 7, a cross-section of electrophoretic electronic paper 700 will be described. Those of skill in the art will appreciate that the following description indicates merely one example of how electronic paper may be formed. Here, electronic paper 700 is formed by providing electrically-charged particles 705 with a dielectric fluid 710. Cell walls 715 and sealing layer 745 constrain the dielectric fluid within to predetermined cells, including cells 720, 725 and 730. Sealing layer 745 is attached to conductor 740 by adhesive 750.

The cells, sealing layer 745 and transparent surface 760 may be formed of various types of plastic material or other similar material. In this example, transparent surface 760 is formed of PET plastic, but any other suitable material may be used. In some implementations, even conductor 740 is formed of conductive plastic. Dielectric fluid may be any convenient type of colored dielectric, such as non-toxic oil.

In this example, particles 705 are white and are positively charged. However, other colors and charges may be used. For example, an early type of electronic paper included tiny, statically charged balls that were black on one side and white on the other. The "text" of the paper was altered by the presence of an electric field, which turned the balls up or down.

Electronic paper 700 works according to a slightly different process. When a negative charge is formed in area 735 of conductor 740, all of the charged particles 705 in cell 720 and a portion of the charged particles 705 in cell 725 migrate through dielectric fluid 710 towards conductor 740. Similarly, when a positive charge is formed in area 755 of conductor 740, all of the charged particles 705 in cell 730 and a portion of the charged particles 705 in cell 725 migrate through dielectric fluid 710 away from conductor 740 and towards transparent surface 760.

When the white particles are adjacent to transparent surface 735, that area of the display (here, the area corresponding with cell 730 and the adjacent portion of cell 725) reflects a white "color" to viewer V. Otherwise, the display will reflect the color of the dielectric fluid, which may be any convenient color. In this example, that area of the display corresponding with cell 720 and the adjacent portion of cell 725 reflects the color of the dielectric fluid.

Currently, some manufacturers are providing electronic paper having 16 levels of grayscale. Grayscale is produced by modulating the applied electric field. Preferably, each shade of gray provided represents a stable condition, which will persist when power is removed.

This example of electronic paper includes an additional conductor layer 765 adjacent to transparent surface 760. Because the display is viewed through conductor layer 765, conductor layer 765 is preferably also transparent, e.g. a transparent conductive plastic.

Figure 8A:
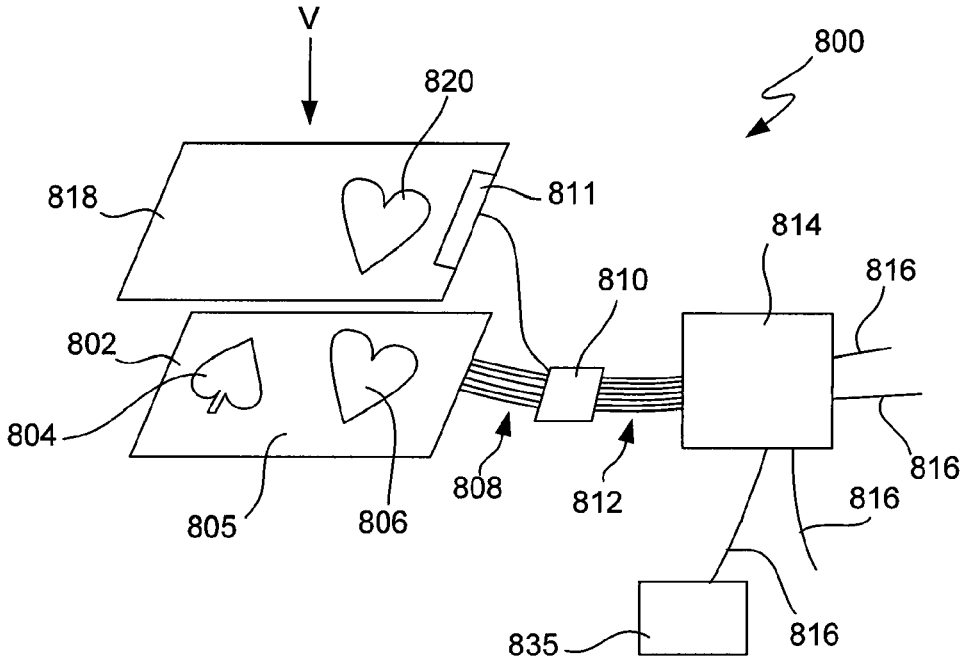
FIGS. 8A and 8B are schematic diagrams that illustrate control systems for two general types of electronic paper that may be used for some configurable surfaces of the present invention.
Figure 8B:
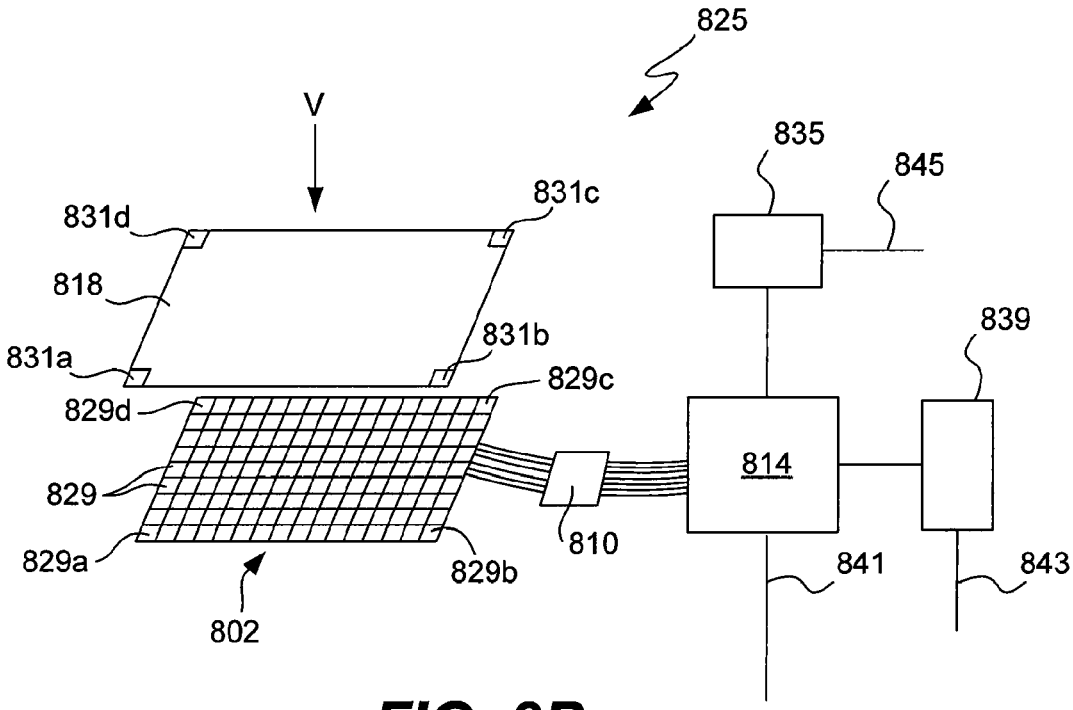

In order to provide adequate resolution, the conductors used to control electronic paper 700 are preferably patterned conductors. Electronic paper having two general types of patterned conductors will now be described with reference to FIGS. 8A and 8B. In the example shown in FIG. 8A, electronic paper 800 includes patterned conductor 802 that has been segmented according to shape 804, shape 806 and background portion 805. Layer 818 includes cells containing dielectric and white, positively charged particles, as described above with reference to FIG. 7. Although layer 818 is shown to be separated from conductor 802 in FIGS. 8A and 8B, this is only for purposes of illustration; in practice, these layers are joined, e.g., by a lamination process.

Driver chip 810 is in communication with conductor 802 via connections 808 and in communication with display processor 814 via connections 812. Here, common ground electrode 811 is also connected to driver 810. In alternative implementations, driver 810 may be implemented as software executed by, e.g., display processor 814. Display processor 814 may communicate with other devices, including memory 835, via connections 816.

In this example, within the entire area of shape 804 or 806, driver 810 will cause essentially the same charge to be applied. Accordingly, all of shape 804 or 806 may be directly driven and separately controlled.

Here, when driver 810 causes a positive charge to be applied to shape 806, the white, positively charged particles are visible to observer V as a corresponding white shape in area 820. Observer V would see the color, or colors, of the dielectric in the remainder of layer 818 and would not see a feature corresponding to shape 804.

In some such implementations, layer 818 may include one or more dielectric fluids having multiple colors. Various effects may be created, even with a relatively simple segmented display such as that depicted in FIG. 8A. For example, the same display may include an effect similar to that used with mosaics (e.g., tile mosaics), a patterned "fill" within a segmented area or any other desired color combination. "Pointillism" effects (wherein the perception of non-primary colors induced by the visual mixing of closely-spaced points of primary colors) may be created by distribution of colored dielectric during fabrication of layer 818 and/or by activating selected colored cells in a matrix. The latter technique requires a more complex version of electronic paper, such as that described below with reference to FIG. 8B.

Other methods and devices may be used for producing multi-colored displays with electronic paper. For example, one may use multiple layers of electronic paper to produce color effects. One such type of color electronic paper has been jointly developed by Fujitsu Laboratories Ltd., Fujitsu Frontech Limited, and Fujitsu Limited (collectively, "Fujitsu"), and was exhibited in July of 2005 at the Tokyo International Forum. This electronic paper includes one layer for producing red color, one layer for producing blue color and one layer for producing green color. No color filters or polarizing layers are required, though they could be used with such a product. According to Fujitsu, the screen color of their electronic paper is unaffected even when the screen is bent, pressed with fingers, etc. E Ink Corporation and Toppan Printing Co. Ltd. announced on Oct. 18, 2005 that their engineers had built a full-color electronic paper display suitable for mass production. This colored electronic paper uses a color filter having a high-brightness layout (red/green/blue/white) that can present white or black for background, text, etc., as well as a range of colors and tones. Those of skill in the art will appreciate that some configurable displays of the present invention can be provided, at least in part, by these and other types of color electronic paper now in existence or that will be developed in the future.

Segmented electronic paper such as electronic paper 800, while somewhat limited in the type of display it can produce, has some advantages. For example, it is simple to control. The instruction set for controlling electronic paper 800 is relatively basic. As such, it requires only a small amount of memory 835 and an inexpensive display processor 814. Segmented electronic paper may advantageously be used for static features such as symbols, logos and the like. Although these features are static, segmented electronic paper may be used to provide a range of such static features that may be switched on or off. In some implementations, however, such switching could be used to implement simple types of animated displays.

Moreover, such segmented electronic paper may be used in combination with electronic paper having greater display flexibility, such as that provided by a more complex patterning in the conductor. An example of one electronic paper 825 will now be described with reference to FIG. 8B.

Electronic paper 825 is an active matrix type of electronic paper, which is made possible by a finer granularity of the patterning in conductor 802. In this example, conductor 802 has been partitioned into rectangular cells 829, each of which is independently addressable and controllable by processor 814, via driver 810. When driver 810 causes a positive charge to be applied to cells 829*a*, 829*b*, 829*c* and 829*d* of conductor 802, the white, positively charged particles in layer 818 are visible to observer V in the corresponding cells 831*a*, 831*b*, 831*c* and 831*d*. As before, the charged particles may be a "color" other than white, may be negatively charged, may be differentially charged on opposing sides, etc.

Although this example uses a conductor patterned into rectangular cells, any convenient cell shape may be used. If the cells are sufficiently small, they can be controlled much like pixels of an LCD or similar display device. Both static and dynamic images may be presented. Depending on the size and complexity of the display, there may be significantly more demands on display processor 814 for an active matrix display than for a segmented display. Moreover, additional memory may be required. Therefore, in this example, display processor 814 is configured for communication with memory devices 835 and 839. Each of these devices is configured for communication with other devices, if necessary, via connections 841, 843 and 845. In this example, memory device 835 is a flash memory device and memory device 839 is an SRAM. However, any convenient type of memory device may be used.

If layer 818 includes cells having different colors of dielectric material, cells 829 may be controlled to produce pointillism effects or similar effects. Only the three primary colors are needed to produce a wide range of perceived colors. For large configurable surfaces and/or configurable surfaces that are at a medium distance from the viewer (e.g., a wall or ceiling surface), such effects may be particularly interesting and entertaining.

Figure 8C:
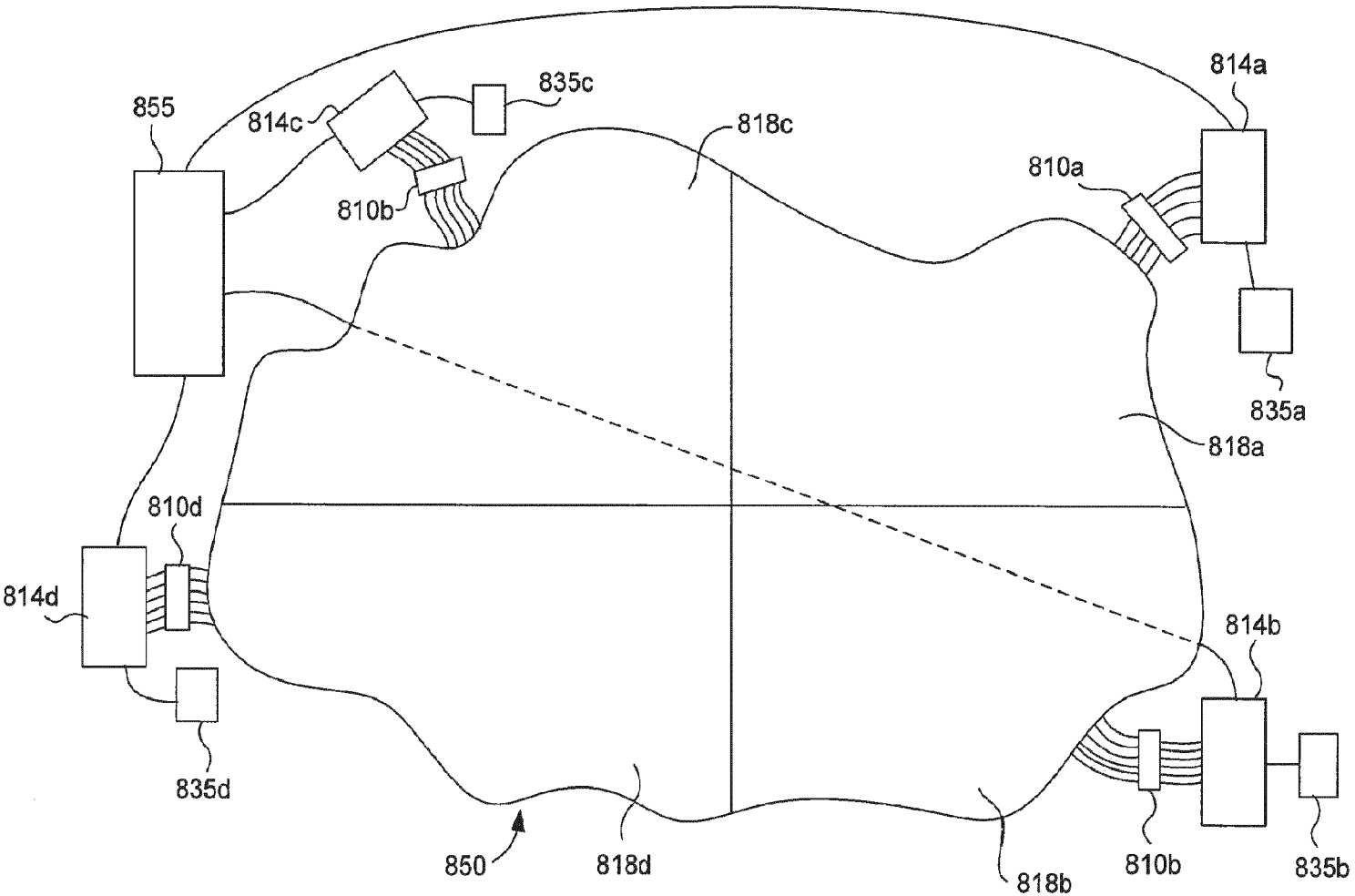
FIG. 8C is a cutaway view of "tiled" configurable surfaces according to one implementation of the invention.

Some such implementations of the invention will now be discussed with reference to FIG. 8C. Configurable surface 850 is formed from multiple, contiguous sections of electronic paper. FIG. 8C indicates a "cutaway" view of electronic paper sections 818*a*, 818*b*, 818*c* and 818*d*. However, more or fewer sections of electronic paper may be used make such a composite or "tiled" configurable surface 850. Moreover, electronic paper sections 818*a*, 818*b*, 818*c* and 818*d* may segmented electronic paper, active matrix electronic paper, another type of electronic paper or any combination thereof.

Here, each of electronic paper sections 818*a*, 818*b*, 818*c* and 818*d* has a corresponding processor, display driver and memory. In this implementation, the sections comprising configurable surface 850 operate, at least in part, according to instructions from environment controller 855. Accordingly, corresponding processors 814*a*, 814*b*, 814*c* and 814*d* are configured for communication with environment controller 855. For example, environment controller 855 may provide instructions to form a new display or a portion thereof, may send a command to produce a display or a portion thereof according to information stored in memories 835*a*, 835*b*, 835*c* and 835*d*, etc.

By combining multiple sections of electronic paper, large configurable surfaces may be created, e.g., wall surfaces, ceiling surfaces, floor surfaces, large signs, etc. Such a configurable surface may be located in the vicinity of one or more gaming machines, table games, a hotel lobby, a lounge, restaurant or bar, or any other suitable environment. Moreover, configurable surface 850 can be configured for communication with other configurable surfaces, other devices, etc., via environment controller 855 and/or other devices. In this way, configurable surfaces spanning a relatively large area can be controlled to produce a desired effect.

For example, one or more configurable surfaces 850 may form a display along a wall, ceiling and/or floor area of one or more rooms of a casino. Glass, epoxy, polyurethane or a similar material may be used to provide a protective layer, particularly if the electronic paper is implemented in a floor. The display could relate to a game theme, to a tournament, to featured entertainment or other activity. The configurable surfaces 850 could be used to divide a space into smaller environments, e.g., to delineate a group gaming area or an area featuring a particular game theme.

Configurable surfaces 850 could be implemented to make wall, ceiling or floor colors and/or patterns changeable. The colors and/or patterns could be programmed to move. For example, configurable surfaces 850 on the walls, ceiling and/or floor of a room could be programmed to display moving fish images to provide an aquarium effect. Similarly, configurable surfaces 850 could be programmed to produce a snowstorm effect, a "money storm" effect or another simulated environmental effect. Configurable surfaces 850 could be programmed to make patterns that correspond with regional themes, seasonal themes, etc. In some implementations, zones of a gaming establishment may be delineated in this way, each of which has a changeable theme. However, it will readily be appreciated that configurable surfaces 850 could be used in contexts other than those of gaming establishments.

Configurable surfaces 850 may also be used to provide a link between areas of a gaming establishment. For example, the configurable surfaces could indicate arrows, messages or the like to guide one or more customers to a predetermined area. A configurable surface in a non-gaming area, such as a lobby, could provide information about gaming activities and/or guide players to one or more gaming areas. Maze games, treasure hunts or the like may be implemented, e.g., through various parts of a casino. Directions and/or clues for such a game may be indicated on configurable surfaces in various locations. Configurable surfaces 850 could provide directions to an exit during an emergency.

Depending on the complexity of the overall display and the other devices involved, environment controller 855 may be implemented by one or more devices, including but not limited to a CPU, a PC or a similar device, a switch, a server, etc. Environment controller 855 may act independently or according to instructions from another device, such as a server, a gaming machine, another environment controller 855, etc.

As described below with reference to FIG. 9, some implementations of the invention provide environment controllers that control speakers, light projectors and other devices for creating additional features of desired environmental effects. Environment controller 855 may cooperate with other such devices to provide an engaging and readily changeable environment. Some such implementations may provide various group gaming features, including but not limited to group bonus events. Some implementations involve interactive gesture-based game control.

Figure 9:
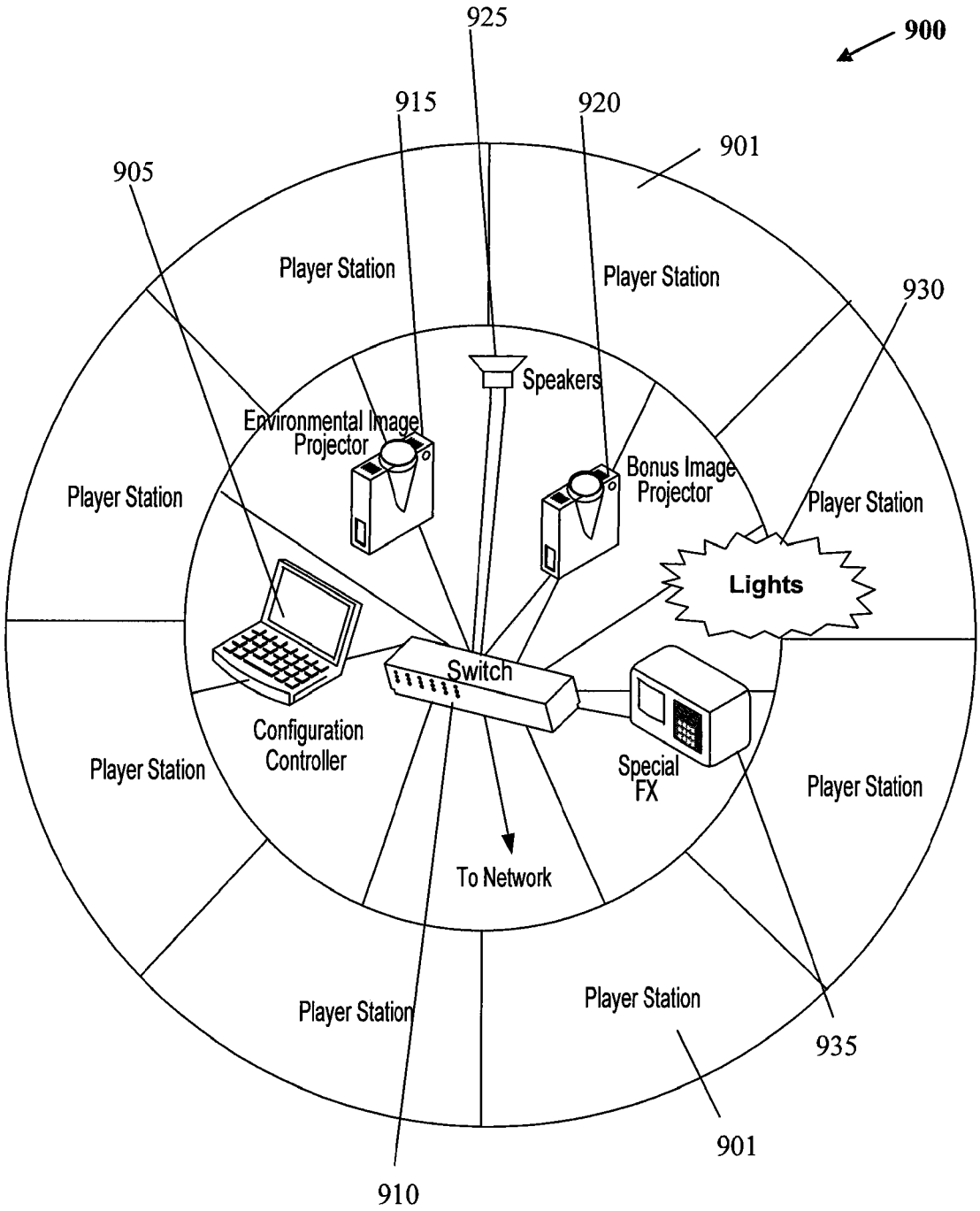
FIG. 9 illustrates one bank of networked player stations and an exemplary system for controlling a local display environment according to some implementations of the invention.

Although many such features may be provided with the previously-described methods and devices, an environmental control system such as that illustrated in FIG. 9 is an integral part of some such implementations of the invention. It will be appreciated that environmental control system 900 of FIG. 9 is merely one example of such a system and that more or fewer devices, different types of devices, etc., may be used within the scope of the invention.

Environmental control system 900 may be implemented, for example, in a bank of gaming machines of a gaming establishment. In this implementation, a group of player stations 901 are connected via a switch 910 to other devices in environmental control system 900. Environment controller 905 controls environmental image projector 915 and bonus image projector 920 to project gaming-related images on nearby surfaces, such as the ceiling, walls, etc. Images may be projected on the underside of a transparent or translucent surface, e.g., a surface on which player stations 901 are positioned.

Environment controller 905 also controls speakers 925 and special effects device(s) 935 to produce effects that preferably correspond with projected images to form a coherent theme. Special effects device(s) 935 may be used, for example, to produce holographic images, smoke, mist or the like (e.g., from sublimating dry ice). In some implementations, a configurable surface (e.g., of electronic paper) may be used as a diaphragm for one or more speakers, e.g., flat-panel speakers. Alternatively, or additionally, speakers may be disposed behind a configurable surface. Holes may be provided in the configurable surface to facilitate sound transmission.

In this example, environment controller 905 comprises a laptop computer configured with task-appropriate software. However, like environment controller 855, environment controller 905 may be implemented by one or more logic devices in machines of various kinds, including but not limited to PCs, servers, gaming machines, etc. Environment controller 905 may act independently or according to instructions from another device, such as a server, a gaming machine, another environment controller, etc. Environment controller 905 may operate according to instructions from a gaming machine (e.g., in response to input from a user interface) or another device at a player station 901. Accordingly, game themes and/or related environments may be configured according to "pull" or "bottom up" approaches as well as "push" or "top down" approaches and peer-to-peer approaches.

Alternatively, or additionally, environment controller 905 may provide instructions to a gaming machine and/or other devices. For example, environment controller 905 may provide instructions to one or more gaming machines to change configurable surfaces. This change may reflect a new game theme, a group game and/or team configuration, etc., or may simply indicate a player's desire to have a different configurable surface displayed. A gaming establishment server may provide instructions to change not only a game theme, but also a corresponding environment for an entire bank of gaming machines, a section of a casino, etc.

Alternatively, a player may make a request (e.g., from a user input device of a gaming machine) to have different gaming machine "skins" displayed, to have a different environment presented, to start playing a different game and/or to form a group for group play. In response, a server may instruct environment controller 905 to create an appropriate display and/or environment for one or more gaming machines. Even a command to change a single gaming machine's configurable surface to reflect a new game theme could be issued by environment controller 905; this arrangement could simplify the hardware and/or software required by each individual gaming machine.

The surfaces on which images are projected may be configurable surfaces, e.g., as described above. A combination of projected images and displayed images provides some advantages. Features requiring greater persistence or higher resolution may be more effectively presented as a display of a configurable surface of, e.g., electronic paper. Moreover, unlike a projected light, displays of a configurable surface are not susceptible to blockage/interference, e.g., by players or passersby.

On the other hand, current forms of electronic paper cannot be dimmed and are not as bright as projected light can be. If someone hits a jackpot or enters a bonus round, for example, one or more of lights 930 could flash and/or projected light from one or more bonus image projectors 920 could be shined more brightly than is currently possible for a corresponding stand-alone display formed from electronic paper. The projected images from one or more bonus image projectors 920 could virtual "money storms" to signify jackpot wins or special gaming events, show virtual games or bonus features, etc. A bonus image projector 920 could project the image of a progressive meter onto a surface near the player stations. A bonus image projector 920 could also project text or images relating to prizes that could be won, travel destinations, etc.

However, light from a projection system may be provided over a wide range of intensities to create various moods and effects. The projected light from one or more environmental image projectors 915 could be made bright, like the mid-day desert sun, or could be subdued and diffuse, like the ambient light in a tropical rain forest. The type and mood of the environment may be created to correspond with a game theme. For example, a Coyote Moon™ implementation could provide soft projected light on darkened paper, with "stars" in the background formed by electronic paper or back-lit pinholes. Desert sounds, such as coyote calls, could be provided by the audio system.

Some implementations of the invention provide gesture detection devices for player interactivity. In some such implementations, one or more player stations include a gesture detection device in communication with environment controller 905 for controlling at least some aspects of environmental control system 900. In one such implementation, one or more player stations are equipped with small cameras that are used to allow players to interact with the system using gestures. Player gestures may be detected by small cameras at each player station or by centrally located camera systems. These gestures can be used to spin virtual wheels, select betting options, move virtual player pieces or interact with the virtual environment.

In some such implementations, players could interact with virtual games provided by environmental control system 900 or the like instead of, or in addition to, games provided by gaming machines, gaming tables, etc. For example, a roulette wheel game might be projected and the players could use hand gestures, foot movements, or other body movements to place their bets. Relevant methods and devices are described in U.S. patent application Ser. No. 11/349,844, filed on Feb. 7, 2006 and entitled "ADVENTURE SEQUENCE ACTIVITIES," which is hereby incorporated by reference for all purposes.

Figure 10:
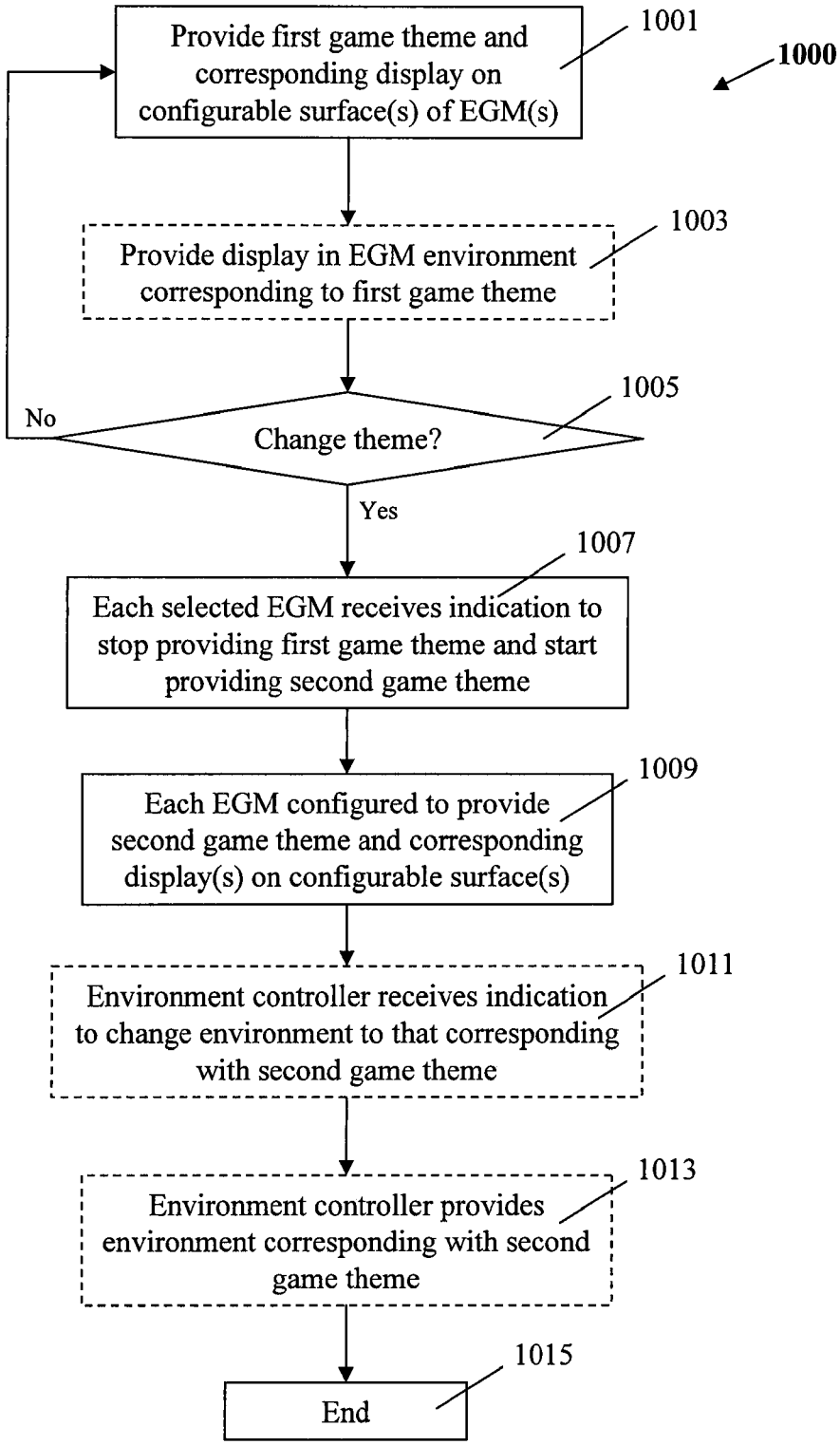
FIG. 10 is a flow chart that outlines some methods of the invention for changing game themes and related displays.

Some implementations for changing game themes and related environments will now be described with reference to FIG. 10. In step 1001, a gaming machine is configured to provide a first game theme. Configurable surfaces of the gaming machine are providing a display in accordance with the first game theme. Optionally, the gaming machine's environment may be associated, at least in part, with the first game theme. (Step 1003.) For example, a nearby wall, ceiling, floor, etc., may include a configurable surface that is presenting a display corresponding to the first game theme. Other effects, such as projected light, special effects, etc., that correspond to the first game theme may be provided by environmental control system 900 or the like.

In step 1005, it is determined whether to change the game theme of at least one gaming machine. This determination may be made by any of various devices and may be based on a range of criteria. For example, if only one gaming machine is involved, the determination could be made by that gaming machine pursuant to a request from a player (made, e.g., via a user interface) to play a different game.

Alternatively, a local server may be in charge of making such determinations. The server may be configured for receiving and processing player requests, whether for group gaming, for changing a game theme, for changing an environment and/or the skin of an EGM. However, in this example, display and/or environment changes are associated with game theme changes. In some implementations, a gaming establishment server or host device make a determination to change a game theme and a corresponding display and/or environment at predetermined times, upon the occurrence of predetermined events, at the discretion of a casino administrator or in response to a request from a player.

In some implementations of the invention, the determination of step 1005 may be in response to a player's request to configure a plurality of gaming machines for group gaming. For example, a player may select a "group game" option from user interface of a gaming machine. The player could request that a certain number of gaming machines (preferably, but not necessarily contiguous gaming machines) be configured for group play, for a particular game theme, etc. The server or other device could determine whether there are enough available gaming machines in the area to form the requested group. If there are, these machines could be configured as requested and an appropriate display and/or environment could be presented.

If there are not enough gaming machines available in the area, the server or other device could propose that fewer local machines be used. If this is not acceptable, the server could suggest that gaming machines in another part of the gaming establishment be used. The recommended part of the gaming establishment could be a relatively less-trafficked area. Accordingly, this method provides the additional advantage of making more effective use of portions of a gaming establishment that might otherwise be overlooked by players.

In some such implementations, a gaming machine could indicate the proposed area of the gaming establishment and/or how the players could get to the area. For example, a display device in a gaming machine could indicate part of a floor plan/gaming machine layout with one or more proposed groups of gaming machines highlighted in some fashion. A user input device (e.g., a touch screen) could be used to select one of the proposed groups. In some instances, floor attendant could be alerted to guide the players to the group area. Ideally, the selected machines could be configured and a group environment may be created even before the players arrive, so the players could find it more easily.

When it is determined in step 1005 that the first game theme will be changed to a second game theme, each gaming machine involved will receive an indication to start providing the second game theme. (Step 1007.) Relevant game software will be provided, if necessary (e.g., as described elsewhere herein).

In this example, each gaming machine involved is configured to change the display(s) on its configurable surface(s) according to the new game theme to be executed. (Step 1009.) In other words, the gaming machines will associate a particular game theme with a corresponding configurable surface display and will present that display when configured to execute the game theme. However, in alternative implementations, a separate indication to provide a particular display and/or environment will be provided to the gaming machines and/or another device (such as environment controller 905). This may be necessary, for example, if there is more than one possible display and/or environment for a given game theme.

In some instances, the server (or other device) may provide instructions to change an environment for a group of gaming machines, e.g., an entire bank of gaming machines, a section of a casino, etc., to an environment corresponding to the new game theme. (Steps 1011 and 1013.) The instructions may be made to an environment controller and/or the relevant gaming machines.

If group play is involved, characteristic colors, patterns, etc., may also be assigned to teams within a group (e.g., a blue team versus a red team). In some group game implementations, environmental change may be triggered by group game outcomes. For example, because of the actions of one or more players in a group's blue team, all blue machines may become eligible to participate in a bonus session.

Figure 11:
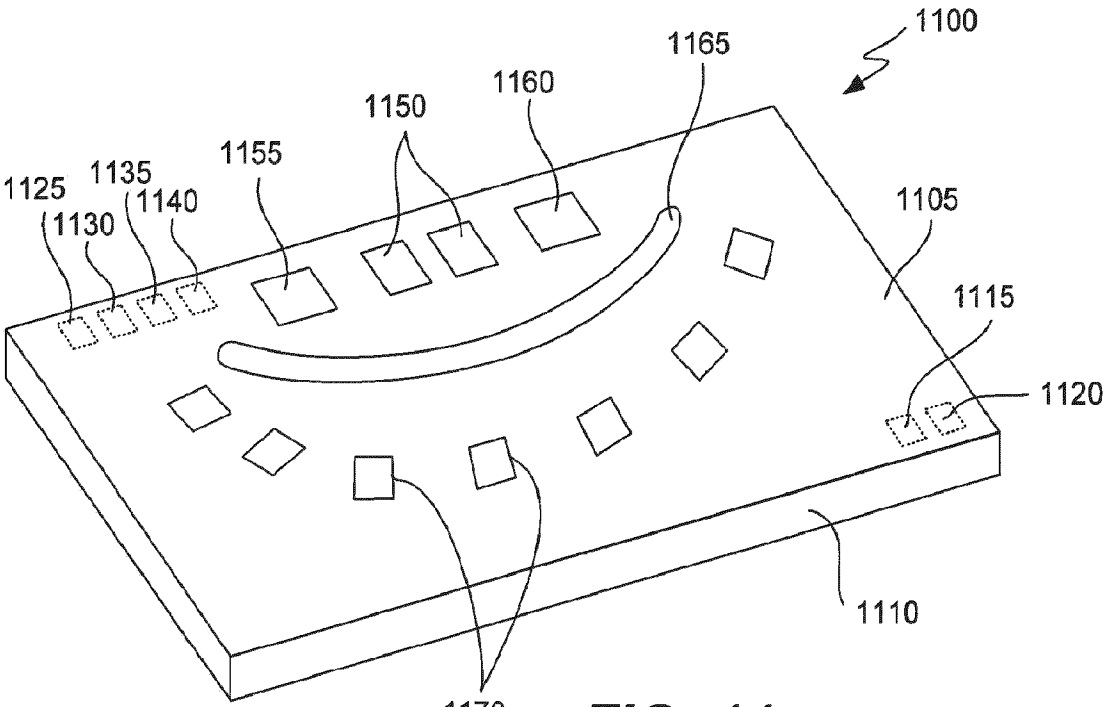
FIG. 11 illustrates a configurable gaming table according to one implementation of the invention.

One exemplary table game implementation of the invention is set forth in FIG. 11. As with the other exemplary embodiments shown and described herein, more, fewer and/or different components may be used for table game embodiments that are fully within the scope of the present invention. Table 1100 includes configurable surface 1105, the display of which has been configured for a blackjack game in this example. Here, table 1100 has been configured for use by players and a human dealer. Accordingly, configurable surface 1105 displays dealer card areas 1150, card shoe area 1155 and chip area 1160 for use by a human dealer. Table 1100 also indicates dealing area 1165, where players' cards are dealt, as well as player betting areas 1170.

Some preferred implementations provide a green background similar in color to the green felt of a traditional table game. However, any convenient color scheme may be chosen for table 1100. Text (e.g., rules and payouts) and other graphics associated with the selected table game are preferably also provided, though not illustrated in FIG. 11. Again, some preferred implementations use a style of lettering and a layout that is evocative of a traditional table game.

Table 1100 includes logic device 1115 for controlling the display of configurable surface 1105. In this embodiment, logic device 1115 can receive instructions from another device (e.g., a table game server, a wireless host device, etc.) via a wireless interface. Information pertaining to such instructions (e.g., an instruction set for controlling configurable surface 1105 to produce a desired display type) may be stored in memory 1120. In this way, a group of tables 1100 may simultaneously be instructed to change their configurations from, e.g., a poker game configuration to a blackjack game configuration.

However, table 1100 can also be controlled according to input from a user interface. In this example, the user interface comprises a series of buttons for selecting a desired table game layout. Pressing button 1125 may, for example, cause table 1100 to display the blackjack layout indicated in FIG. 11. Buttons 1130, 1135 and 1140, for example, may be used to reconfigure table 1100 for other types of table games, including but not limited to poker games and other card games.

The persistence and configurability of electronic paper is a positive attribute for table game implementations of the invention. Although various types of electronic paper could be used in forming table games, segmented electronic paper displays provide some advantages as compared to active matrix type electronic paper displays. The conductors of a segmented electronic paper display can be patterned into shapes that correspond with the table games to be offered, providing crisp edges to symbols, logos, lettering and all aspects of the table layout. This is also possible with active matrix type displays, but the instruction set for controlling segmented electronic paper to form the desired displays is very simple (as compared to the corresponding instruction set required for an active matrix display). Therefore, a simpler processor 1115 and a smaller memory 1120 may be used. However, active matrix type displays provide greater flexibility and allow new types of table game layouts to be displayed.

Although the implementation shown in FIG. 11 is intended for use by a human dealer, some implementations of the invention provide automated tables for table gaming. Some such implementations provide RFID chips, RFID readers, cameras, gesture detection devices, etc. At least some of these features change according to the type of table game provided.

A projection system or the like may also be used to provide reconfigurable table game surfaces. For example, some alternative implementations of the invention provide projected light from underneath a translucent table surface. However, such systems alone are not preferred for table game implementations, in part because it is difficult to provide the desired level of resolution necessary for clearly displaying text, symbols, etc., at such a close range to the players.

Some gaming networks described herein include a central system that is configured to download game software and data to networked gaming machines. The game theme of a particular networked gaming machine (or a group of networked gaming machines) may be changed according to instructions received from the central system. Such gaming networks allow for the convenient provisioning of networked gaming machines and allow additional game themes to be easily and conveniently added, if desired. Related software, including but not limited to game software, may be downloaded to networked gaming machines.

Relevant information is set forth in U.S. patent application Ser. No. 11/225,407 , by Wolf et al., entitled "METHODS AND DEVICES FOR MANAGING GAMING NETWORKS" and filed Sep. 12, 2005, in U.S. patent application Ser. No. 10/757,609 by Nelson et al., entitled "METHODS AND APPARATUS FOR GAMING DATA DOWNLOADING" and filed on Jan. 14, 2004, in U.S. patent application Ser. No. 10/938,293 by Benbrahim et al., entitled "METHODS AND APPARATUS FOR DATA COMMUNICATION IN A GAMING SYSTEM" and filed on Sep. 10, 2004, in U.S. patent application Ser. No. 11/225,337 by Nguyen et al., filed Sep. 12, 2005 and entitled "DISTRIBUTED GAME SERVICES" and in U.S. patent application Ser. No. 11/173,442 by Kinsley et al., filed Jul. 1, 2005 and entitled "METHODS AND DEVICES FOR DOWNLOADING GAMES OF CHANCE," all of which are hereby incorporated by reference in their entirety and for all purposes. Some exemplary gaming networks and devices are below.

Exemplary System Architecture

Figure 12:
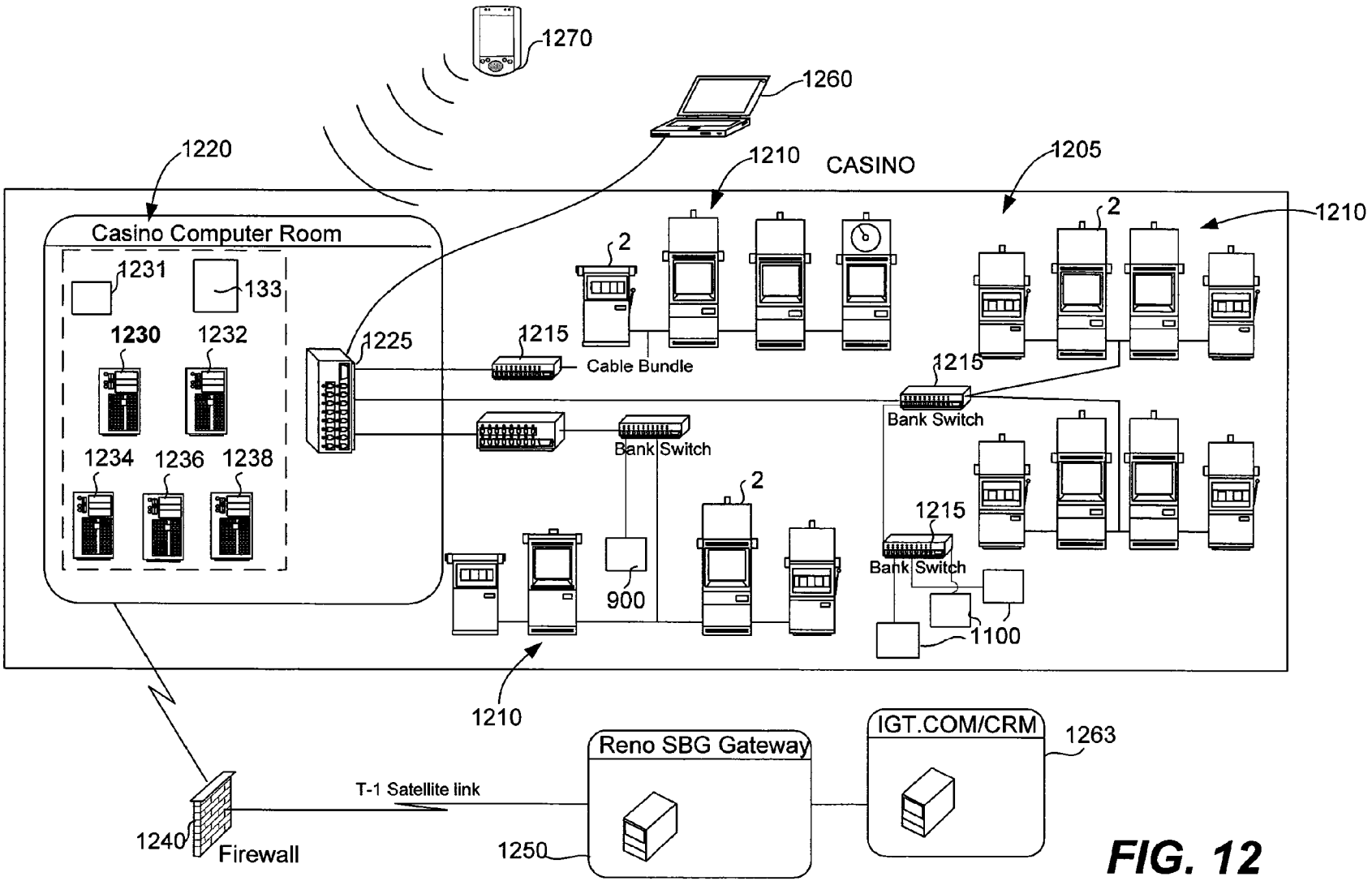
FIG. 12 illustrates one example of a network topology for implementing some aspects of the present invention.

One example of a network topology for implementing some aspects of the present invention is shown in FIG. 12. Those of skill in the art will realize that this exemplary architecture and the related functionality are merely examples and that the present invention encompasses many other such embodiments and methods. Here, for example, a single gaming establishment 1205 is illustrated, which is a casino in this example. However, it should be understood that some implementations of the present invention involve multiple gaming establishments.

Gaming establishment 1205 includes 16 gaming machines 2, each of which is part of a bank 1210 of gaming machines 2. Some of the gaming machines, wall, floor and ceilings of gaming establishment 1205 comprise configurable surfaces, though these are not shown in FIG. 12. One bank of gaming machines features an environmental control system 900. It will be appreciated that many gaming establishments include hundreds or even thousands of gaming machines 2, not all of which are included in a bank 1210. In this example, gaming establishment 1205 also includes a bank of configurable gaming tables 1100. However, the present invention may be implemented in gaming establishments having any number of gaming machines, environmental control systems and configurable surfaces, including but not limited to configurable surfaces of gaming tables.

Various alternative network topologies can be used to implement different aspects of the invention and/or to accommodate varying numbers of networked devices. For example, gaming establishments with very large numbers of gaming machines 2 may require multiple instances of some network devices (e.g., of main network device 1225, which combines switching and routing functionality in this example) and/or the inclusion of other network devices not shown in FIG. 12. For example, some implementations of the invention include one or more middleware servers disposed between gaming machines 2 and server 1230. Such middleware servers can provide various useful functions, including but not limited to the filtering and/or aggregation of data received from bank switches 1215, from individual gaming machines and from other player terminals. Some implementations of the invention include load balancing methods and devices for managing network traffic.

Each bank of gaming machines or configurable gaming tables has a corresponding bank switch 1215, which may be a conventional bank switch. Each bank switch is connected to server-based gaming ("SBG") server 1230 via main network device 1225, which combines switching and routing functionality in this example. Although various floor communication protocols may be used, some preferred implementations use IGT's open, Ethernet-based SuperSAS® protocol, which IGT makes available for downloading without charge. However, other protocols such as Best of Breed ("BOB") may be used to implement various aspects of SBG. IGT has also developed a gaming-industry-specific transport layer called CASH that rides on top of TCP/IP and offers additional functionality and security.

SBG server 1230, License Manager 1231, Arbiter 133, servers 1232, 1234, 1236 and 1238, and main network device 1225 are disposed within computer room 1220 of gaming establishment 1205. In practice, more or fewer servers may be used. Some of these servers may be configured to perform tasks relating to player tracking, bonusing/progressives, etc. Some servers may be configured to perform tasks specific to the present invention, e.g., as environment control servers, table game servers, group game servers, etc. License Manager 1231 may also be implemented, at least in part, via a server or a similar device. Some exemplary operations of License Manager 1231 are described in detail in U.S. patent application Ser. No. 11/225,408 , entitled "METHODS AND DEVICES FOR AUTHENTICATION AND LICENSING IN A GAMING NETWORK" by Kinsley et al., which is hereby incorporated by reference.

SBG server 1230 can also be configured to implement, at least in part, various aspects of the present invention. Some preferred embodiments of SBG server 1230 and the other servers shown in FIG. 12 include (or are at least in communication with) clustered CPUs, redundant storage devices, including backup storage devices, switches, etc. Such storage devices may include a redundant array of inexpensive disks ("RAID"), back-up hard drives and/or tape drives, etc. Preferably, a Radius and a DHCP server are also configured for communication with the gaming network. Some implementations of the invention provide one or more of these servers in the form of blade servers.

In some implementations of the invention, many of these devices (including but not limited to License Manager 1231 servers 1232, 1234, 1236 and 1238, and main network device 1225) are mounted in a single rack with SBG server 1230. Accordingly, many or all such devices will sometimes be referenced in the aggregate as an "SBG server." However, in alternative implementations, one or more of these devices is in communication with SBG server 1230 and/or other devices of the network but located elsewhere. For example, some of the devices could be mounted in separate racks within computer room 1220 or located elsewhere on the network. For example, it can be advantageous to store large volumes of data elsewhere via a storage area network ("SAN").

In some embodiments, these components are SBG server 1230 preferably has an uninterruptible power supply ("UPS"). The UPS may be, for example, a rack-mounted UPS module.

Computer room 1220 may include one or more operator consoles or other host devices that are configured for communication with SBG server 1230. Such host devices may be provided with software, hardware and/or firmware for implementing various aspects of the invention; many of these aspects involve controlling SBG server 1230. However, such host devices need not be located within computer room 1220. Wired host device 1260 (which is a laptop computer in this example) and wireless host device 1270 (which is a PDA in this example) may be located elsewhere in gaming establishment 1205 or at a remote location.

Arbiter 133 may be implemented, for example, via software that is running on a server or another networked device. Arbiter 133 serves as an intermediary between different devices on the network. Some implementations of Arbiter 133 are described in U.S. patent application Ser. No. 10/948,387, entitled "METHODS AND APPARATUS FOR NEGOTIATING COMMUNICATIONS WITHIN A GAMING NETWORK" and filed Sep. 23, 2004 (the "Arbiter Application"), which is incorporated herein by reference and for all purposes. In some preferred implementations, Arbiter 133 is a repository for the configuration information required for communication between devices on the gaming network (and, in some implementations, devices outside the gaming network). Although Arbiter 133 can be implemented in various ways, one exemplary implementation is discussed in the following paragraphs.

Figure 13:
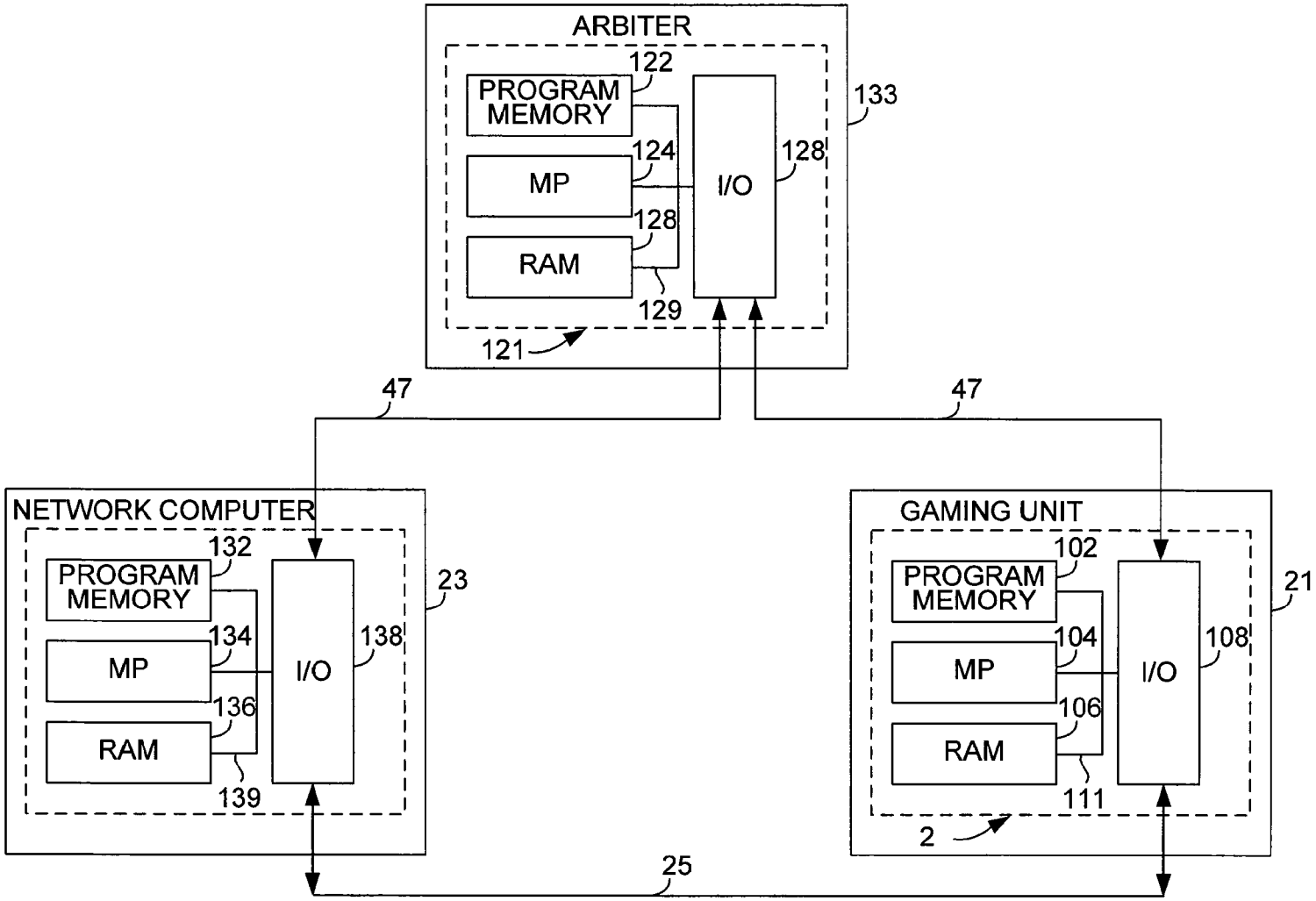
FIG. 13 is a block diagram that illustrates a simplified network topology for some implementations of an Arbiter.

FIG. 13 is a block diagram of a simplified communication topology between a gaming unit 21, the network computer 23 and the Arbiter 133. Although only one gaming unit 21, one network computer 23 and one Arbiter 133 are shown in FIG. 13, it should be understood that the following examples may be applicable to different types of network gaming devices within the gaming network 12 beyond the gaming unit 21 and the network computer 23, and may include different numbers of network computers, gaming security arbiters and gaming units. For example, a single Arbiter 133 may be used for secure communications among a plurality of network computers 23 and tens, hundreds or thousands of gaming units 21. Likewise, multiple gaming security arbiters 46 may be utilized for improved performance and other scalability factors.

Referring to FIG. 13, the Arbiter 133 may include an arbiter controller 121 that may comprise a program memory 122, a microcontroller or microprocessor (MP) 124, a random-access memory (RAM) 126 and an input/output (I/O) circuit 128, all of which may be interconnected via an address/data bus 129. The network computer 23 may also include a controller 131 that may comprise a program memory 132, a microcontroller or microprocessor (MP) 134, a random-access memory (RAM) 136 and an input/output (I/O) circuit 138, all of which may be interconnected via an address/data bus 139. It should be appreciated that although the Arbiter 133 and the network computer 23 are each shown with only one microprocessor 124, 134, the controllers 121, 131 may each include multiple microprocessors 124, 134. Similarly, the memory of the controllers 121, 131 may include multiple RAMs 126, 136 and multiple program memories 122, 132. Although the I/O circuits 128, 138 are each shown as a single block, it should be appreciated that the I/O circuits 128, 138 may include a number of different types of I/O circuits. The RAMs 124, 134 and program memories 122, 132 may be implemented as semiconductor memories, magnetically readable memories, and/or optically readable memories, for example.

Although the program memories 122, 132 are shown in FIG. 13 as read-only memories (ROM) 122, 132, the program memories of the controllers 121, 131 may be a read/write or alterable memory, such as a hard disk. In the event a hard disk is used as a program memory, the address/data buses 129, 139 shown schematically in FIG. 13 may each comprise multiple address/data buses, which may be of different types, and there may be an I/O circuit disposed between the address/data buses.

As shown in FIG. 13, the gaming unit 21 may be operatively coupled to the network computer 23 via the data link 25. The gaming unit 21 may also be operatively coupled to the Arbiter 133 via the data link 47, and the network computer 23 may likewise be operatively coupled to the Arbiter 133 via the data link 47. Communications between the gaming unit 21 and the network computer 23 may involve different information types of varying levels of sensitivity resulting in varying levels of encryption techniques depending on the sensitivity of the information. For example, communications such as drink orders and statistical information may be considered less sensitive. A drink order or statistical information may remain encrypted, although with moderately secure encryption techniques, such as RC4, resulting in less processing power and less time for encryption. On the other hand, financial information (e.g., account information, winnings, etc.), game download information (e.g., game software and game licensing information) and personal information (e.g., social security number, personal preferences, etc.) may be encrypted with stronger encryption techniques such as DES or 3DES to provide increased security.

As disclosed in further detail in the Arbiter Application, the Arbiter 133 may verify the authenticity of each network gaming device. The Arbiter 133 may receive a request for a communication session from a network device. For ease of explanation, the requesting network device may be referred to as the client, and the requested network device may be referred to as the host. The client may be any device on the network 12 and the request may be for a communication session with any other network device. The client may specify the host, or the gaming security arbiter may select the host based on the request and based on information about the client and potential hosts. The Arbiter 133 may provide encryption keys (session keys) for the communication session to the client via the secure communication channel. Either the host and/or the session key may be provided in response to the request, or may have been previously provided. The client may contact the host to initiate the communication session. The host may then contact the Arbiter 133 to determine the authenticity of the client. The Arbiter 133 may provide affirmation (or lack thereof) of the authenticity of the client to the host and provide a corresponding session key, in response to which the network devices may initiate the communication session directly with each other using the session keys to encrypt and decrypt messages.

Alternatively, upon receiving a request for a communication session, the Arbiter 133 may contact the host regarding the request and provide corresponding session keys to both the client and the host. The Arbiter 133 may then initiate either the client or the host to begin their communication session. In turn, the client and host may begin the communication session directly with each other using the session keys to encrypt and decrypt messages. An additional explanation of the communication request, communication response and key distribution is provided in the Arbiter Application.

Wireless devices are particularly useful for managing a gaming network. Such wireless devices could include, but are not limited to, laptops, PDAs or even cellular telephones. Referring once again to FIG. 12, one or more network devices in gaming establishment 1205 can be configured as wireless access points. For example, a casino manager may use a wireless handheld device to revise and/or schedule gaming machine configurations while roaming the casino floor. Similarly, a representative of a regulatory body could use a PDA to verify gaming machine configurations, generate reports, view activity logs, etc., while on the casino floor.

If a host device is located in a remote location, security methods and devices (such as firewalls, authentication and/or encryption) should be deployed in order to prevent the unauthorized access of the gaming network. Similarly, any other connection between gaming network 1205 and the outside world should only be made with trusted devices via a secure link, e.g., via a virtual private network ("VPN") tunnel. For example, the illustrated connection between SBG 1230, gateway 1250 and central system 1263 (here, IGT.com) that may be used for game downloads, etc., is advantageously made via a VPN tunnel.

An Internet-based VPN uses the open, distributed infrastructure of the Internet to transmit data between sites. A VPN may emulate a private IP network over public or shared infrastructures. A VPN that supports only IP traffic is called an IP-VPN. VPNs provide advantages to both the service provider and its customers. For its customers, a VPN can extend the IP capabilities of a corporate site to remote offices and/or users with intranet, extranet, and dial-up services. This connectivity may be achieved at a lower cost to the gaming entity with savings in capital equipment, operations, and services. Details of VPN methods that may be used with the present invention are described in the reference, "Virtual Private Networks-Technologies and Solutions," by R. Yueh and T. Strayer, Addison-Wesley, 2001, ISBN#0-201-70209-6, which is incorporated herein by reference and for all purposes.

There are many ways in which IP VPN services may be implemented, such as, for example, Virtual Leased Lines, Virtual Private Routed Networks, Virtual Private Dial Networks, Virtual Private LAN Segments, etc. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols, including RFC reports, may be obtained from the VPN Consortium, an industry trade group (http://www.vpnc.com, VPNC, Santa Cruz, Calif.).

For security purposes, any information transmitted to or from a gaming establishment over a public network may be encrypted. In one implementation, the information may be symmetrically encrypted using a symmetric encryption key, where the symmetric encryption key is asymmetrically encrypted using a private key. The public key may be obtained from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. A different symmetric encryption key is used for each transaction where the key is randomly generated. Symmetric encryption and decryption is preferably applied to most information because symmetric encryption algorithms tend to be 100-10,000 faster than asymmetric encryption algorithms.

As mentioned elsewhere herein, U.S. patent application Ser. No. 11/225,408 , entitled "METHODS AND DEVICES FOR AUTHENTICATION AND LICENSING IN A GAMING NETWORK" by Kinsley et al., describes novel methods and devices for authentication, game downloading and game license management. This application has been incorporated herein by reference.

Providing a secure connection between the local devices of the SBG system and IGT's central system allows for the deployment of many advantageous features. For example, a customer (e.g., an employee of a gaming establishment) can log onto an account of central system 1263 (in this example, IGT.com) to obtain the account information such as the customer's current and prior account status.

Moreover, such a secure connection may be used by the central system 1263 to collect information regarding a customer's system. Such information includes, but is not limited to, error logs for use in diagnostics and troubleshooting. Some implementations of the invention allow a central system to collect other types of information, e.g., information about the usage of certain types of gaming software, revenue information regarding certain types of games and/or gaming machines, etc. Such information includes, but is not limited to, information regarding the revenue attributable to particular games at specific times of day, days of the week, etc. Such information may be obtained, at least in part, by reference to an accounting system of the gaming network(s), as described in U.S. patent application Ser. No. 11/225,407 , by Wolf et al., entitled "METHODS AND DEVICES FOR MANAGING GAMING NETWORKS," which has been incorporated herein by reference.

Automatic updates of a customer's SBG server may also be enabled. For example, central system 1263 may notify a local SBG server regarding new products and/or product updates. For example, central system 1263 may notify a local SBG server regarding updates of new gaming software, gaming software updates, peripheral updates, the status of current gaming software licenses, etc. In some implementations of the invention, central system 1263 may notify a local SBG server (or another device associated with a gaming establishment) that an additional theme-specific data set and/or updates for a previously-downloaded global payout set are available. Alternatively, such updates could be automatically provided to the local SBG server and downloaded to networked gaming machines.

After the local SBG server receives this information, it can identify relevant products of interest. For example, the local SBG server may identify gaming software that is currently in use (or at least licensed) by the relevant gaming entity and send a notification to one or more host devices, e.g., via email. If an update or a new software product is desired, it can be downloaded from the central system. Some relevant downloading methods are described elsewhere herein and in applications that have been incorporated herein by reference, e.g., in U.S. patent application Ser. No. 11/078,966. Similarly, a customer may choose to renew a gaming software license via a secure connection with central system 1263 in response to such a notification.

Secure communication links allow notifications to be sent securely from a local SBG server to host devices outside of a gaming establishment. For example, a local SBG server can be configured to transmit automatically generated email reports, text messages, etc., based on predetermined events that will sometimes be referred to herein as "triggers." Such triggers can include, but are not limited to, the condition of a gaming machine door being open, cash box full, machine not responding, verification failure, etc.

In addition, providing secure connections between different gaming establishments can enable alternative implementations of the invention. For example, a number of gaming establishments, each with a relatively small number of gaming machines, may be owned and/or controlled by the same entity. In such situations, having secure communications between gaming establishments makes it possible for a gaming entity to use a single SBG server as an interface between central system 1263 and the gaming establishments.

Figure 14:
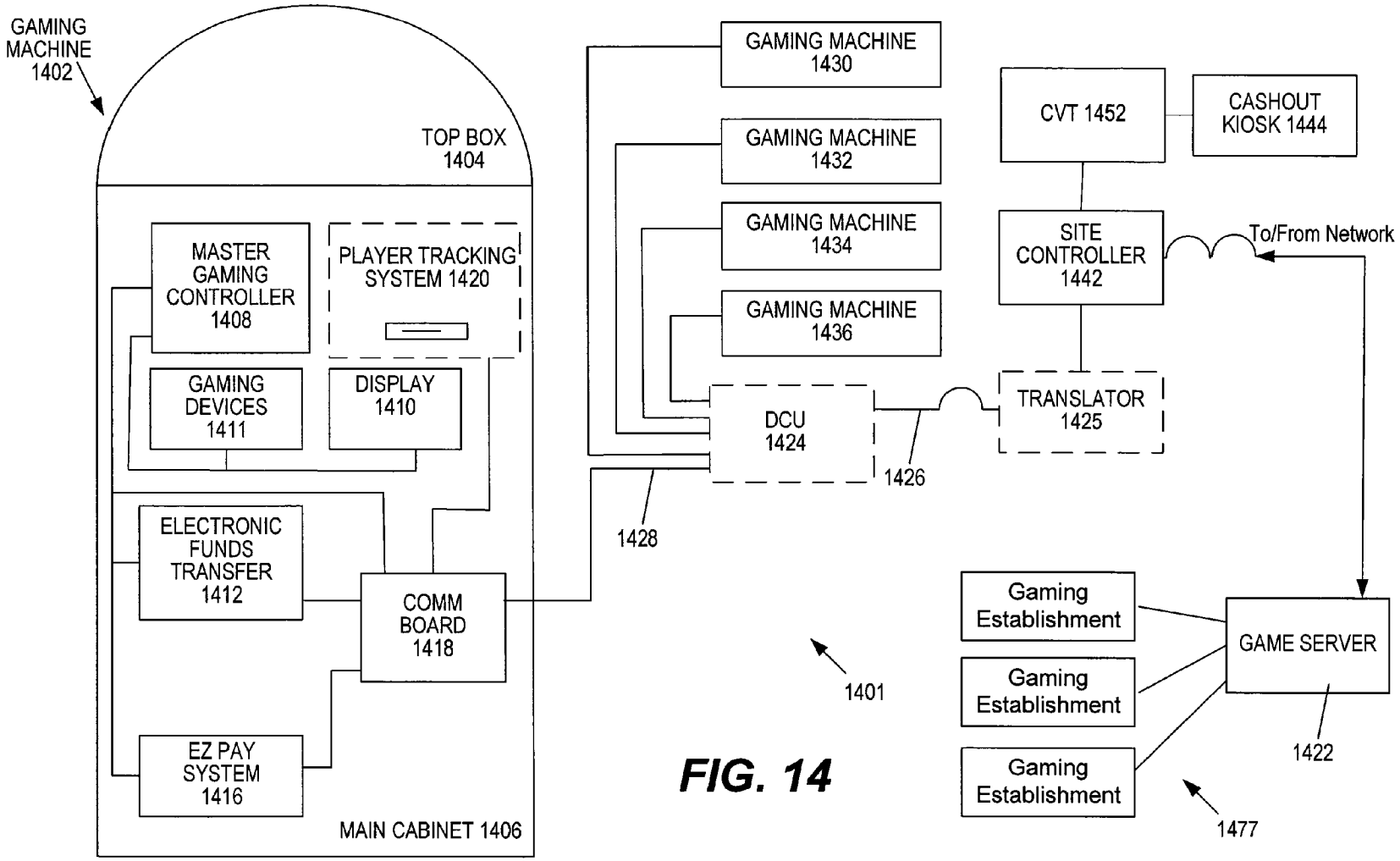
FIG. 14 illustrates a gaming machine and a gaming network that may be configured according to some aspects of the invention.

A gaming network that may be used to implement additional methods performed in accordance with embodiments of the invention is depicted in FIG. 14. Gaming establishment 1401 could be any sort of gaming establishment, such as a casino, a card room, an airport, a store, etc. In this example, gaming network 1477 includes more than one gaming establishment, all of which are networked to game server 1422.

Here, gaming machine 1402, and the other gaming machines 1430, 1432, 1434, and 1436, include a main cabinet 1406 and a top box 1404. The main cabinet 1406 houses the main gaming elements and can also house peripheral systems, such as those that utilize dedicated gaming networks. The top box 1404 may also be used to house these peripheral systems.

The master gaming controller 1408 controls the game play on the gaming machine 1402 according to instructions and/or game data from game server 1422 or stored within gaming machine 1402 and receives or sends data to various input/output devices 1411 on the gaming machine 1402. In one embodiment, master gaming controller 1408 includes processor(s) and other apparatus of the gaming machines described above in FIGS. 6 and 7. The master gaming controller 1408 may also communicate with a display 1410.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1408 may also communicate with EFT system 1412, EZPay™ system 1416 (a proprietary cashless ticketing system of the present assignee), and player tracking system 1420. The systems of the gaming machine 1402 communicate the data onto the network 1422 via a communication board 1418.

It will be appreciated by those of skill in the art that embodiments of the present invention could be implemented on a network with more or fewer elements than are depicted in FIG. 14. For example, player tracking system 1420 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Moreover, player tracking information may be combined with other information that is now readily obtainable by an SBG system.

Moreover, DCU 1424 and translator 1425 are not required for all gaming establishments 1401. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1442 provides this function for gaming establishment 1401. Site controller 1442 is connected to a central system and/or other gaming establishments via one or more networks, which may be public or private networks. Among other things, site controller 1442 communicates with game server 1422 to obtain game data, such as ball drop data, bingo card data, etc.

In the present illustration, gaming machines 1402, 1430, 1432, 1434 and 1436 are connected to a dedicated gaming network 1422. In general, the DCU 1424 functions as an intermediary between the different gaming machines on the network 1422 and the site controller 1442. In general, the DCU 1424 receives data transmitted from the gaming machines and sends the data to the site controller 1442 over a transmission path 1426. In some instances, when the hardware interface used by the gaming machine is not compatible with site controller 1442, a translator 1425 may be used to convert serial data from the DCU 1424 to a format accepted by site controller 1442. The translator may provide this conversion service to a plurality of DCUs.

Further, in some dedicated gaming networks, the DCU 1424 can receive data transmitted from site controller 1442 for communication to the gaming machines on the gaming network. The received data may be, for example, communicated synchronously to the gaming machines on the gaming network.

Here, CVT 1452 provides cashless and cashout gaming services to the gaming machines in gaming establishment 1401. Broadly speaking, CVT 1452 authorizes and validates cashless gaming machine instruments (also referred to herein as "tickets" or "vouchers"), including but not limited to tickets for causing a gaming machine to display a game result and cash-out tickets. Moreover, CVT 1452 authorizes the exchange of a cashout ticket for cash. These processes will be described in detail below. In one example, when a player attempts to redeem a cash-out ticket for cash at cashout kiosk 1444, cash out kiosk 1444 reads validation data from the cashout ticket and transmits the validation data to CVT 1452 for validation. The tickets may be printed by gaming machines, by cashout kiosk 1444, by a stand-alone printer, by CVT 1452, etc. Some gaming establishments will not have a cashout kiosk 1444. Instead, a cashout ticket could be redeemed for cash by a cashier (e.g. of a convenience store), by a gaming machine or by a specially configured CVT.

Figure 15:
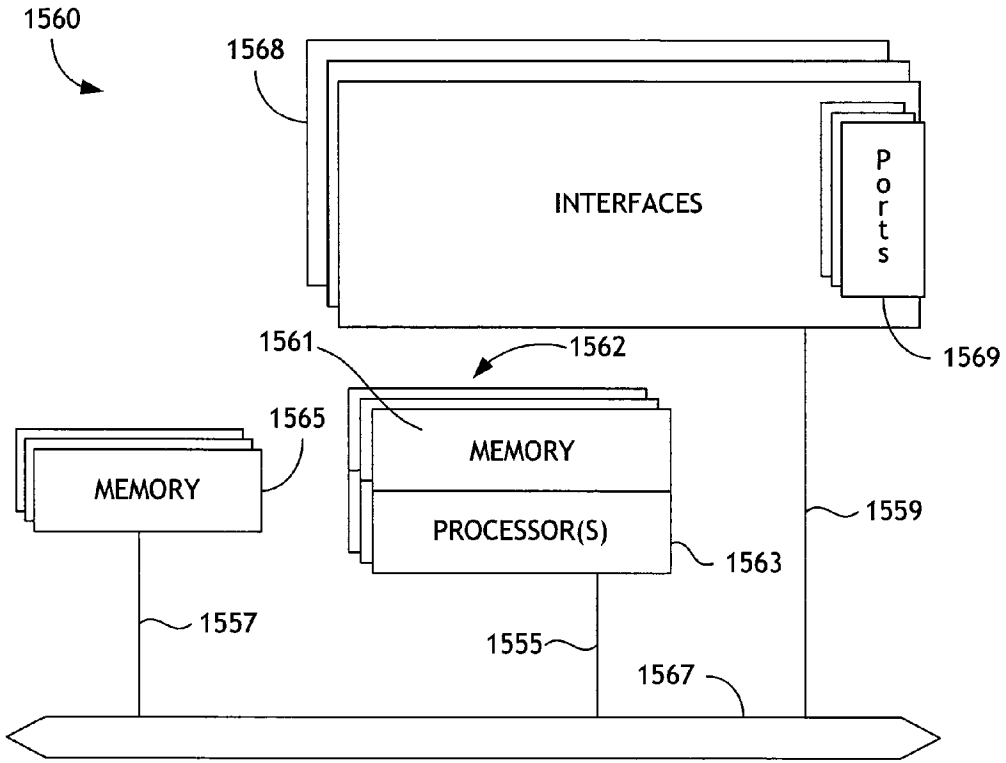
FIG. 15 illustrates a network device that may be configured according to some aspects of the invention.

FIG. 15 illustrates an example of a network device that may be configured for implementing some methods of the present invention. Network device 1560 includes a master central processing unit (CPU) 1562, interfaces 1568, and a bus 1567 (e.g., a PCI bus). Generally, interfaces 1568 include ports 1569 appropriate for communication with the appropriate media. In some embodiments, one or more of interfaces 1568 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1568 control such communications-intensive tasks as encryption, decryption, compression, decompression, packetization, media control and management. By providing separate processors for the communications-intensive tasks, interfaces 1568 allow the master microprocessor 1562 efficiently to perform other functions such as routing computations, network diagnostics, security functions, etc.

The interfaces 1568 are typically provided as interface cards (sometimes referred to as "linecards"). Generally, interfaces 1568 control the sending and receiving of data packets over the network and sometimes support other peripherals used with the network device 1560. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1562 may be responsible for implementing specific functions associated with the functions of a desired network device. According to some embodiments, CPU 1562 accomplishes all these functions under the control of software including an operating system and any appropriate applications software.

CPU 1562 may include one or more processors 1563 such as a processor from the Motorola family of microprocessors or the MIPS family of microprocessors. In an alternative embodiment, processor 1563 is specially designed hardware for controlling the operations of network device 1560. In a specific embodiment, a memory 1561 (such as non-volatile RAM and/or ROM) also forms part of CPU 1562. However, there are many different ways in which memory could be coupled to the system. Memory block 1561 may be used for a variety of purposes such as, for example, caching and/or storing data, programming instructions, etc.

Regardless of the network device's configuration, it may employ one or more memories or memory modules (such as, for example, memory block 1565) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 15 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 15) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention.

Although illustrative embodiments and applications of this invention are shown and described herein, many variations and modifications are possible which remain within the concept, scope, and spirit of the invention, and these variations would become clear to those of ordinary skill in the art after perusal of this application. Accordingly, the present embodiments are to be considered as illustrative and not restrictive, and the invention is not to be limited to the details given herein, but may be modified within the scope and equivalents of the appended claims.

We claim:

1. A table having an electronically changeable tabletop for providing different table games at different times, comprising:

a support structure;

a processor;

an interface, coupled to the processor, configured to receive from the processor first instructions for displaying a game theme and second instructions for displaying a layout for a desired table game; and a configurable display mounted to the support structure, the configurable display comprising electronic paper, the configurable display at least partially disposed along a top surface of the table, electronically coupled to the processor, and configured to:

(a) display, according to the first instructions, a graphical image associated with the game theme, and (b) display, according to the second instructions, the layout at the top surface of the table to provide visual boundaries necessary for manually playing the desired table game.

2. The table of claim 1, wherein the interface comprises a network interface.

3. The table of claim 1, wherein the interface comprises a user interface.

4. The table of claim 1, wherein the configurable display surface is configured to continue to display the layout configured for playing the desired table game and the graphical image associated with the game theme when the processor is not powered.

5. The table of claim 1, wherein the display of the layout for playing the desired table game includes visual boundaries needed to play a game selected from the group consisting of a blackjack, poker, and other card games.

6. The table of claim 1, wherein the processor is configured to cooperate with at least one other device to display a graphical image associated with a game theme on one or more surfaces other than the configurable display surface.

7. The table of claim 6, wherein the one or more surfaces other than the configurable display surface comprise one or more second configurable surfaces.

8. The table of claim 6, wherein the one or more surfaces other than the configurable display surface comprise a wall surface, a floor surface, a ceiling surface or a sign surface.

9. The table of claim 1, wherein:

the previously aforementioned game theme is a first game theme and the previously aforementioned graphical image is a first graphical image; and the interface is further configured to receive from the processor third instructions for displaying a second graphical image associated with a second game theme, and wherein the configurable display is configured to change the first graphical image associated with the first game theme to the second graphical image associated with the second game theme according to the third instructions.

10. The table of claim 9,wherein the previously aforementioned layout is a first layout, the interface is further configured to receive from the processor fourth instructions for displaying a second layout for a second desired table game, and wherein the configurable display is configured to change the layout at the top surface of the table to provide visual boundaries necessary for manually playing the second desired table game.

11. A table having an electronically changeable tabletop for providing different table games at different times, comprising:

a support structure;

a processor;

an interface, coupled to the processor, configured to receive from the processor first instructions for displaying a game theme and second instructions for displaying a layout for a desired table game; and a configurable display mounted to the support structure, at least partially disposed along a top surface of the table, electronically coupled to the processor, and configured to:

(a) display, according to the first instructions, a graphical image associated with the game theme, and (b) display, according to the second instructions, the layout at the top surface of the table to provide visual boundaries necessary for manually playing the desired table game; and wherein:

the configurable display is configured to continue to display the layout configured for playing the desired table game and the graphical image associated with the game theme when the processor is not powered.

12. The table of claim 11, wherein the interface comprises a network interface.

13. The table of claim 11, wherein the interface comprises a user interface.

14. The table of claim 11, wherein the display of the layout for playing the desired table game includes visual boundaries needed to play a game selected from the group consisting of a blackjack, poker, and other card games.

15. The table of claim 11, wherein the processor is configured to cooperate with at least one other device to display a graphical image associated with a game theme on one or more surfaces other than the configurable display surface.

16. The table of claim 15, wherein the one or more surfaces other than the configurable display surface comprise one or more second configurable surfaces.

17. The table of claim 15, wherein the one or more surfaces other than the configurable display surface comprise a wall surface, a floor surface, a ceiling surface or a sign surface.

18. The table of claim 11, wherein:

the previously aforementioned game theme is a first game theme and the previously aforementioned graphical image is a first graphical image; and the interface is further configured to receive from the processor third instructions for displaying a second graphical image associated with a second game theme, and wherein the configurable display is configured to change the first graphical image associated with the first game theme to the second graphical image associated with the second game theme according to the third instructions.

19. The table of claim 18, wherein the previously aforementioned layout is a first layout, the interface is further configured to receive from the processor fourth instructions for displaying a second layout for a second desired table game, and wherein the configurable display is configured to change the layout at the top surface of the table to provide visual boundaries necessary for manually playing the second desired table game.

* * * * *

UNITED STATES PATENT AND TRADEMARK OFFICE

CERTIFICATE OF CORRECTION

PATENT NO. : 8,864,567 B2
APPLICATION NO. : 11/880937
DATED : October 21, 2014
INVENTOR(S) : Underdahl et al.

It is certified that error appears in the above-identified patent and that said Letters Patent is hereby corrected as shown below:

IN THE CLAIMS

Claim 4, Column 37, Line 19, delete “surface”.
Claim 5, Column 37, Line 26, delete “a”.
Claim 6, Column 37, Line 29, replace “a” with --the--.
Claim 14, Column 38, Line 28, delete “a”.
Claim 15, Column 38, Line 31, replace “a” with --the--.

Signed and Sealed this
Second Day of June, 2015

Michelle K. Lee

Michelle K. Lee
*Director of the United States Patent and Trademark Office*